US010404004B2

(12) United States Patent
Fuda

(10) Patent No.: US 10,404,004 B2
(45) Date of Patent: Sep. 3, 2019

(54) ELECTRICAL CORD CONNECTORS, ADAPTERS, ADAPTABLE REPLACEMENT CONNECTORS, NON-WIRED FITTINGS, AND A CHRISTMAS LIGHT SOCKET CLIP

(71) Applicant: Cosimio Fuda, Toronto (CA)

(72) Inventor: Cosimio Fuda, Toronto (CA)

( * ) Notice: Subject to any disclaimer, the term of this patent is extended or adjusted under 35 U.S.C. 154(b) by 0 days.

(21) Appl. No.: 15/629,733

(22) Filed: Jun. 21, 2017

(65) Prior Publication Data

US 2018/0048085 A1 Feb. 15, 2018

Related U.S. Application Data

(60) Provisional application No. 62/352,886, filed on Jun. 21, 2016.

(51) Int. Cl.

| | |
|---|---|
| ***F21S 4/10*** | (2016.01) |
| ***H01R 13/44*** | (2006.01) |
| ***H01R 24/20*** | (2011.01) |
| ***H01R 13/64*** | (2006.01) |
| ***H01R 24/28*** | (2011.01) |
| ***H01R 31/06*** | (2006.01) |
| ***F21V 21/088*** | (2006.01) |
| ***F21V 23/06*** | (2006.01) |
| ***H01R 25/00*** | (2006.01) |
| *F21W 121/00* | (2006.01) |

(52) U.S. Cl.

CPC ..... *H01R 13/44* (2013.01); *F21S 4/10* (2016.01); *F21V 21/088* (2013.01); *F21V 23/06* (2013.01); *H01R 13/64* (2013.01); *H01R 24/20* (2013.01); *H01R 24/28* (2013.01); *H01R 25/003* (2013.01); *H01R 31/06* (2013.01); *F21W 2121/00* (2013.01)

(58) Field of Classification Search

CPC ..... F21S 4/10

See application file for complete search history.

(56) References Cited

U.S. PATENT DOCUMENTS

| | | | | |
|---|---|---|---|---|
| 1,895,656 A * | 1/1933 | Gadke | ..... | A47G 33/105 24/339 |
| 3,128,141 A * | 4/1964 | Krupp | ..... | F21V 21/002 439/419 |
| 3,151,926 A * | 10/1964 | Schick | ..... | F21V 21/002 439/419 |

(Continued)

*Primary Examiner* — Tho D Ta

(57) ABSTRACT

The present invention relates to electrical cords and more specifically to electric cord connectors for various uses, including holiday lighting, that allows Christmas light strings to be installed with either end of the cord connectors at the power source. A connector can include a receiving port for a corresponding connector. Both male and female connectors of the present invention, can be manufactured on the electric cords or can include individual replacement type connectors or adaptable replacement connectors. Cords with just a first and second female connector are coupled together and the aligned contact slots are linked with a linking male fitting. An adapter cord powers up the these cords with an activating male fitting. The improved cords, used for holiday lighting, such as Christmas, also includes an improved Christmas light socket with clip, wherein the light socket is one half of the clip and an elongated body member is the other half, resulting in an improved clip with less parts that can be broken.

23 Claims, 20 Drawing Sheets

(56) References Cited

U.S. PATENT DOCUMENTS

| | | | | | |
|---|---|---|---|---|---|
| 3,206,712 | A * | 9/1965 | Schick | F21V 21/002 | 439/419 |
| 3,214,724 | A * | 10/1965 | McIntosh | F21V 21/002 | 439/419 |
| RE28,710 | E * | 2/1976 | Finkelstein | F21V 19/006 | 439/419 |
| 4,012,106 | A * | 3/1977 | Filson | H01R 13/115 | 439/730 |
| 4,904,195 | A | 2/1990 | Thackeray | | |
| 5,007,857 | A | 4/1991 | Wright | | |
| 5,150,964 | A * | 9/1992 | Tsui | F21S 4/10 | 362/122 |
| 5,232,381 | A | 8/1993 | Yu | | |
| 5,466,165 | A | 11/1995 | Geis et al. | | |
| 5,834,901 | A * | 11/1998 | Shen | F21V 23/06 | 315/185 S |
| 6,305,828 | B1 * | 10/2001 | Huang | F21V 19/0005 | 362/249.01 |
| 7,029,312 | B2 | 4/2006 | Reid | | |
| 8,092,255 | B2 * | 1/2012 | Wang | F21V 23/06 | 362/365 |
| D751,377 | S | 9/2014 | Duffy et al. | | |
| 9,190,785 | B1 | 11/2015 | Rogero | | |

* cited by examiner 28
26
20

5
33

10
16
14
12
20
26
24
22
53

10
16
12
51
14

Fig. 6C
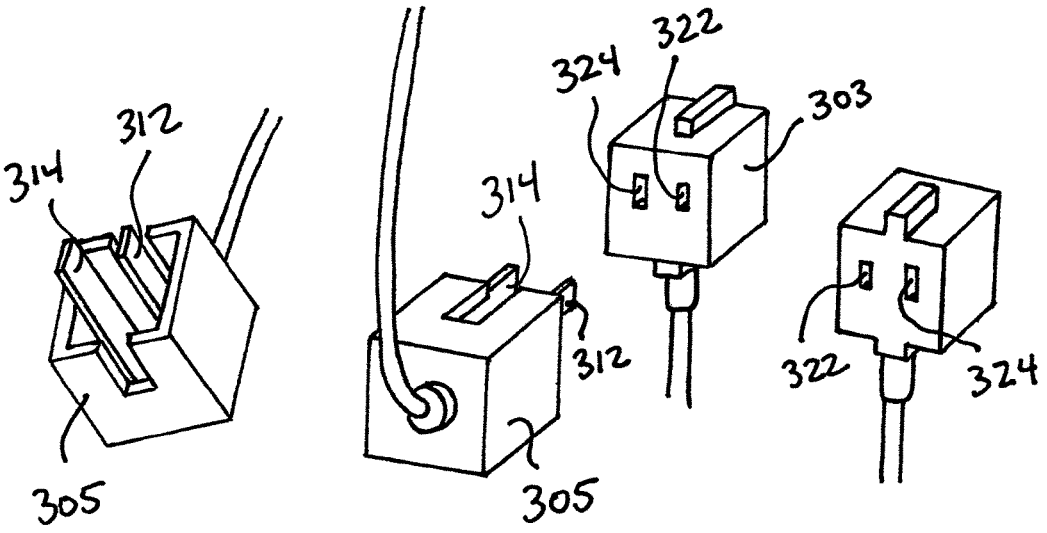
Fig. 6E
Fig. 6D
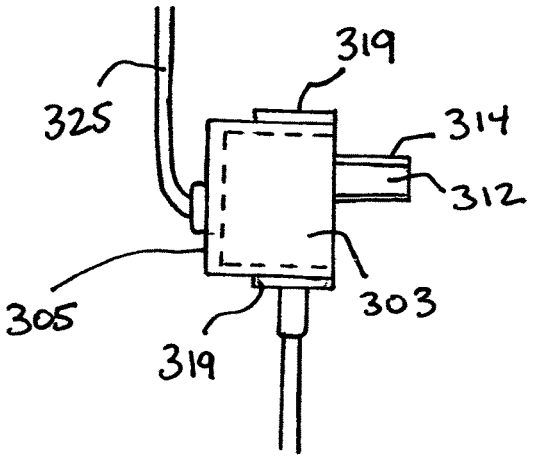
Fig. 6F

Fig. 12B
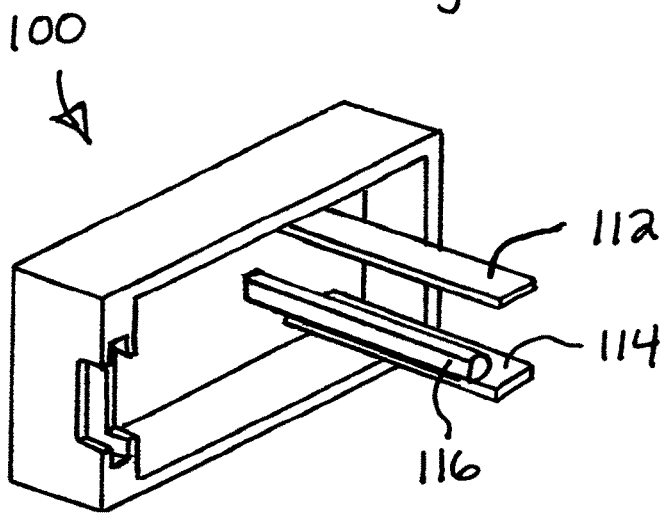
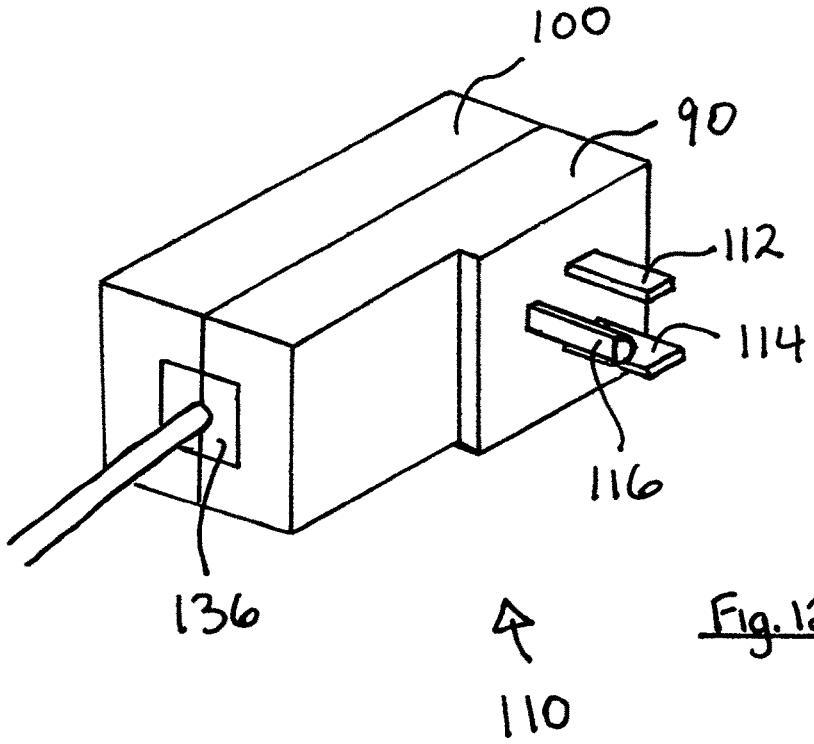
Fig. 12C

ELECTRICAL CORD CONNECTORS, ADAPTERS, ADAPTABLE REPLACEMENT CONNECTORS, NON-WIRED FITTINGS, AND A CHRISTMAS LIGHT SOCKET CLIP

FIELD

This present invention relates to electrical cords and more specifically to electric cord connectors.

BACKGROUND

Electrical cords connect to power sources through male plugs into female electrical sockets, and electric cords can be extended through a female connector of one cord connecting to a male plug connector of another cord. However, electrical cords are sometimes hung or installed in reverse, or the electrical cord connectors may get damaged and require replacing. For example, outdoor Christmas lights can accidently be installed in reverse, with the male plug furthest away from the intended power source, requiring either a long extension cord to connect the male plug end to the power source, or the lights to be taken down and reinstalled in the other direction, with the connectors in the correct position. An unsafe option is to remove the female connector end, installing a male plug in its place, and then plugging into an outlet, creating a very dangerous electrical hazard at every male connection, and at the exposed prongs of the male plug at the opposite end of the lights.

The contents of all of these patents and published applications are hereby incorporated by reference. Various modifications and combinations have been envisaged for electrical plugs, receptacles, adapters and combinations therein, as set out in U.S. Pat. Nos. 5,232,381, 4,904,195 and U.S. Pat. No. 7,029,312 describes an electrical cord with a male plug at both ends, for use when an electrical cord or a string of lights ends in a female connector at the electrical outlet, instead of a male plug.

SUMMARY

The first aspect of the present invention, provides for installing an electrical cord or a string of lights in either direction. The first version includes an electrical cord manufactured with a "male" connector end and "female" connector end. The male connector includes a receiving port, sized to receive the corresponding female connector of another electrical cord or adapter, and provides part of the safety aspect to operate these electrical cord sets. A power adapter cord is used to connect these cords or light strings to a power source, which includes both corresponding connectors of the cord set, along with a male plug for connecting to the power source. and allowing the lights, including Christmas lights, to be installed or mounted in either direction. A splitter adapter cord can be provided to connect and install multiple cords in different directions. The adapter cords can include an on/off switch, and the power adapter can also include a GFCI breaker.

A second version also provides for installation of an electrical cord or a string of lights in either direction. The electrical cord having just "female" connectors, and a linking male fitting, for connectively linking the connectors. The electrical cord includes at least one connector with a receiving port, sized to receive the corresponding female connector of another string of lights or electrical cord. The female connector with receiving port includes an electrical receptacle with a hot contact slot and neutral contact slot that is continuous and open to the receiving port below, for aligning with the contact slots of the corresponding female connector. The linking male fitting includes a hot prong and a neutral prong, for inserting into both female connectors, and to complete the electrical connection of two electrical cords. An adapter cord includes both female connectors, for connecting to either corresponding end of the lights, and also includes a male plug, to plug into an electrical outlet and power the lights.

These connectors mentioned above, can also be manufactured as replacement connectors to replace conventional male and female connectors, to save existing electrical cords or to replace a connector when it becomes damaged.

Another aspect of the present invention, provides for a light socket clip for an electrical cord, or for various holiday lighting, including Christmas lights. The light socket is one half of a spring operated clip, and can include either a compression spring, or torsion spring. A rubber boot cover can be included to protect the compression spring from being damaged.

A further aspect of the present inventions provides for a replacement male or female connector, or an adaptable replacement connector, for repairing various electrical cords when the connectors become damaged. The female and male connectors can include common internal components, such as an inner housing and electrical contact with wire terminals housed in the inner housing, for converting to or from either connector, by using a substitute mounting base and mounting cover. The electrical contacts are open from both ends, permitting a detachable mounting cover of the male connector to be inserted through the common internal parts and exit out the slot openings of the corresponding mounting base. A plug with a broken or missing ground prong, when a ground should be present, may still function, but is unsafe to use. The male cover can easily be replaced if any of the prongs become damaged, and without requiring any rewiring of the connector.

The adaptable or replacement connector, either female or male, can save time and money, by not having to replace the connector or electrical cord completely. The concept can be applied to other applications, such as a 3 way splitter adapter.

The concepts mentioned above, may be applied for use in other applications or electrical connections, including for RV and generator hookups, that can include a female connector having contact slots that are continuous and open from both sides of the connector, for use with a male fitting.

BRIEF DESCRIPTION OF THE FIGURES

For better understanding, these and other aspects of the present invention will be apparent from the brief description of the drawings and the following detailed description in which:

FIG. 6*c* shows a perspective view of the fourth female connector and the first activating male fitting of the present invention.

FIG. 6*d* shows a back perspective view of the fourth embodiment female connector of FIGS. 6*a*-6*c*.

FIG. 6*e* shows a front perspective view of the first activating male fitting of FIGS. 6*a*-6*c*.

FIG. 6*f* shows a perspective view of the first activating male fitting inserted into the fourth female connector.

FIG. 12*b* shows a side perspective view of the male replacement connector cover prongs of FIG. 12*a*.

FIG. 12*c* shows a perspective view of the adaptable male replacement connector of FIG. 12*a* with an electrical cord wired to it.

DETAILED DESCRIPTION OF THE INVENTION

The present invention includes embodiments of various electrical female and male connectors. For simplicity and understanding of the present invention, various male connectors and male fittings may be reference to "blades or prongs" should be understood to have the same meaning for purposes of understanding the invention.

FIGS. 1 and 2 show two types of cord sets with various connectors that can be used for holiday lighting. Other figures below describe various adapters to provide power to these cords.

Figures 1A, 1B, 1C:
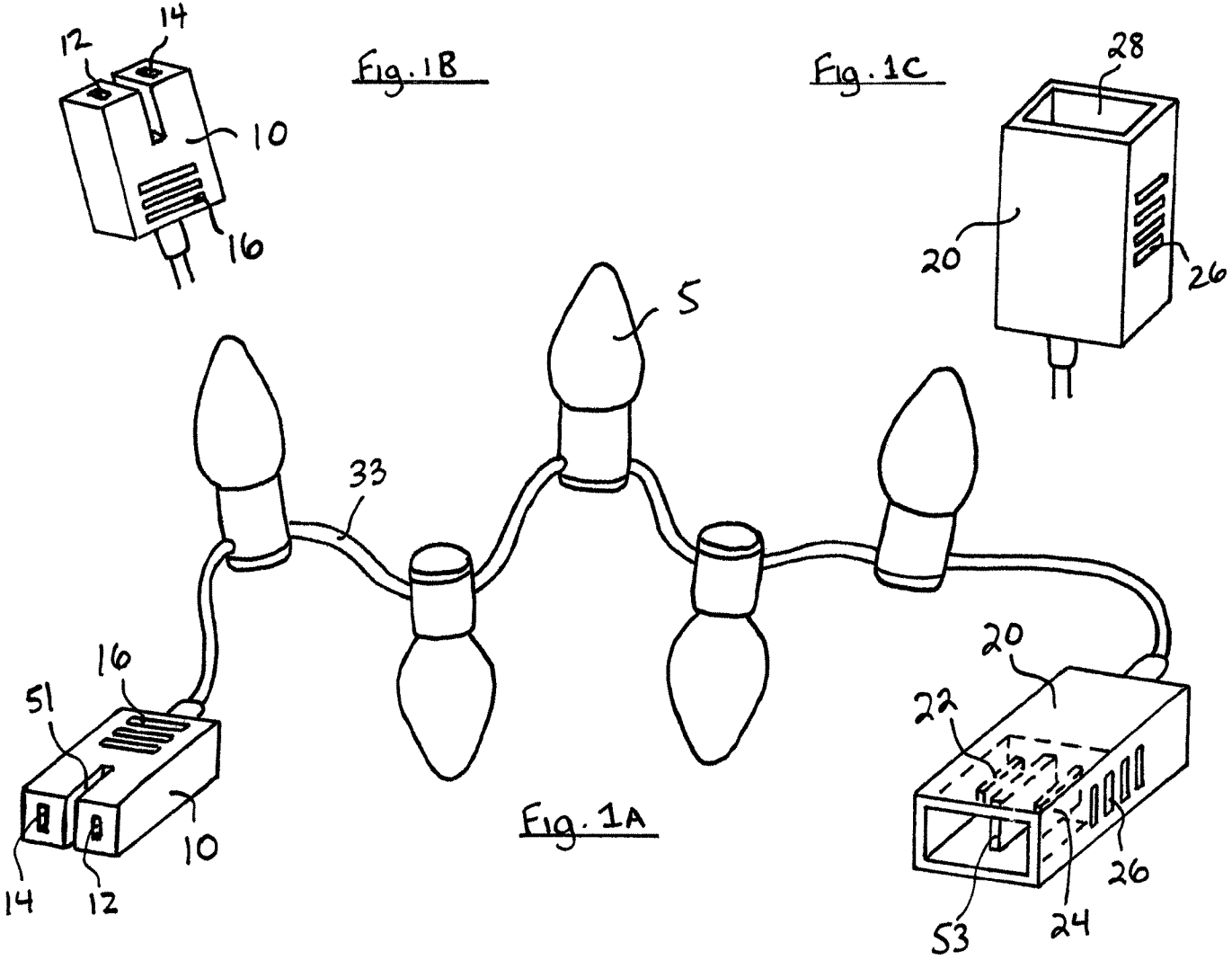
FIG. 1*a* shows a perspective view of a first embodiment of a female connector and a first embodiment of a male connector on the respective ends of a string of Christmas lights.
FIG. 1*b* shows a bottom perspective view of the first female connector of FIG. 1*a*.
FIG. 1*c* shows a bottom perspective view of the first embodiment male connector of FIG. 1*a*.

FIG. 1*a* shows a string of Christmas lights 5 with embodiments of a first female connector 10 at one end of an electrical cord and a first male connector 20 provided at the opposing of the electrical cord 33. The female connector 10 includes a one piece molded outer housing, with an electrical receptacle having a hot contact slot 12, and a neutral contact slot 14, on the end of the connector. A slot 51 is provided between the contact slots of the female connector 10, corresponding to a protective partition 53 of the male connector 20. The outer housing may optionally include grips 16 for gripping.

The first male connector 20, comprises a one piece molded outer housing, with a hot prong (blade) slot 22, and a neutral prong (blade) 24, within a receiving port 28. The prongs of the connector are recessed further back from the entry of the receiving port 28 and the protective partition 53 separates the hot and neutral prongs, and acts as a safety feature to make physical contact with the prongs (blades) more difficult. The string of Christmas lights 5 on cord 33, can also have ends with multiple female connectors 10, or multiple male connectors 20, or a combination of a female and male connectors. Optionally, the housing may include grips 26, for gripping and separating the two connectors.

FIG. 1*b* shows the bottom of the first female connector 10 with hot slot 12 and neutral slot 14 and first grips 16.

FIG. 1*c* shows a bottom perspective view of the first male connector 20, with receiving port 28 and second grips 26.

For simplicity, like components are given the same reference numerals.

Figures 2A, 2B, 2C:
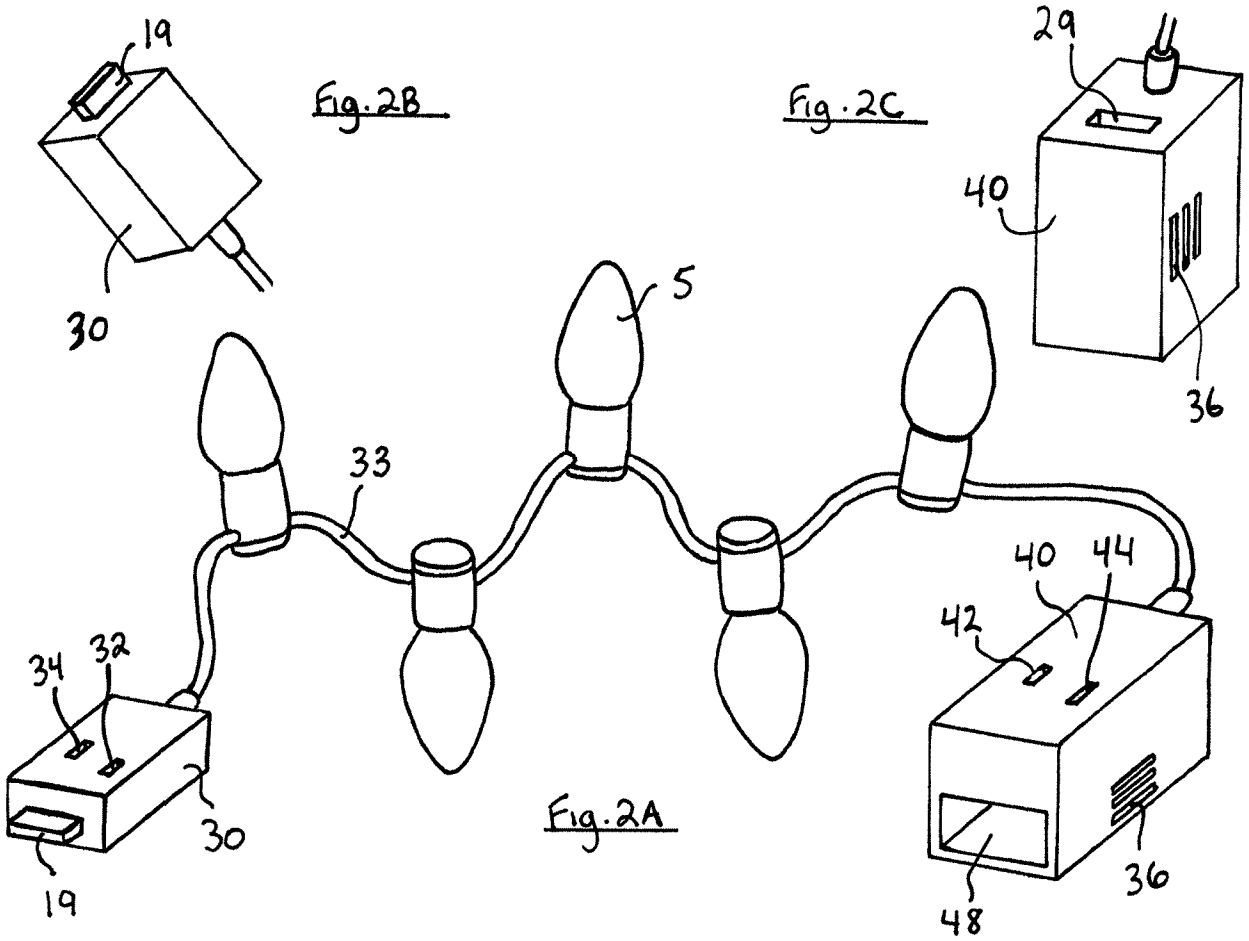
FIG. 2*a* shows a perspective view of an embodiment of a second female connector and a third female connector on the respective ends of a string of Christmas lights.
FIG. 2*b* shows a bottom perspective view of the second embodiment female connector of FIG. 2*a*.
FIG. 2*c* shows a bottom perspective view of the third embodiment female connector of FIG. 2*a*.

FIG. 2*a* shows a string of Christmas lights 5 with an embodiment of a second female connector 30 and an embodiment of a third female connector 40, connected at opposing ends of an electrical cord 33. The female connector 30 includes an outer housing, with an electrical receptacle on the top of the connector, having a hot contact slot 32 and a neutral contact slot 34. A tab 19 is provided on the free end of the female connector 30, for use with slot opening 29, in the back of the female connector 40, shown in FIG. 2*c*.

The third female connector 40 includes an outer housing, with an electrical receptacle having a hot contact slot 42 and a neutral contact slot 44, that are continuous and opened to the receiving port 48, below. The receiving port 48 is partly closed on the other end, and includes a slot opening 29, as shown in FIG. 2*c*, allowing tab 19, on the end of connector 30, to exit past the opening. The partly closed end acts as a stop when receiving the second female connector 30, aligning both connectors and their contact slots, and forming the contiguous hot contact slot and the contiguous neutral contact slot. The tab 19 can be pushed inwards, while holding onto the third female connector 40, to assist in separating the two connectors apart. Optionally the housing may include grips 36. A power adapter cord 330, of FIG. 6*b*, is required to power cord 33 and any additional cords.

FIG. 2*b* shows the bottom of the second female connector 30 of FIG. 2*a*, with no access to the receptacle contact slots from the back (bottom) of the connector, and the tab 19 on the free end FIG. 2*c* shows a bottom perspective view of the third female connector 40 of FIG. 2*a*, with a slot 29 provided at the back of the receiving port 48, and third grips 36 on the sides of the connector.

Figure 2F:
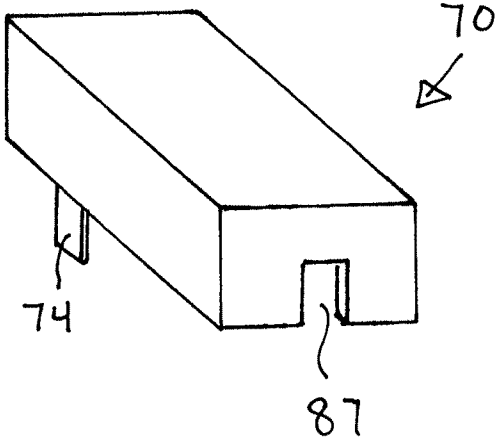
FIG. 2*f* shows an end view of the first linking male fitting of FIGS. 2*d* and 2*e*.
Figure 2D:
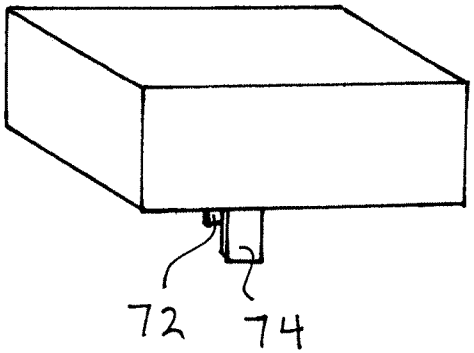
FIG. 2*d* shows a side perspective view of a first linking male fitting for connectively linking the contact slots of the second female connector to the contact slots of the third female connectors of another Christmas light cord.
Figure 2E:
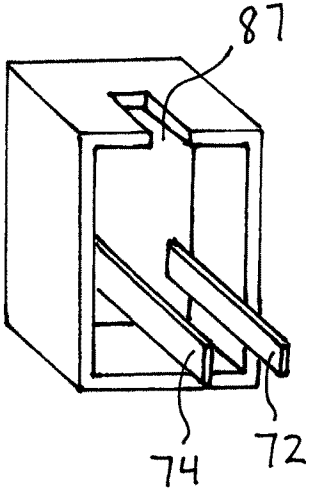
FIG. 2*e* is bottom perspective view of the first linking male fitting of FIG. 2*d*.
Figures 4A, 4B, 4C:
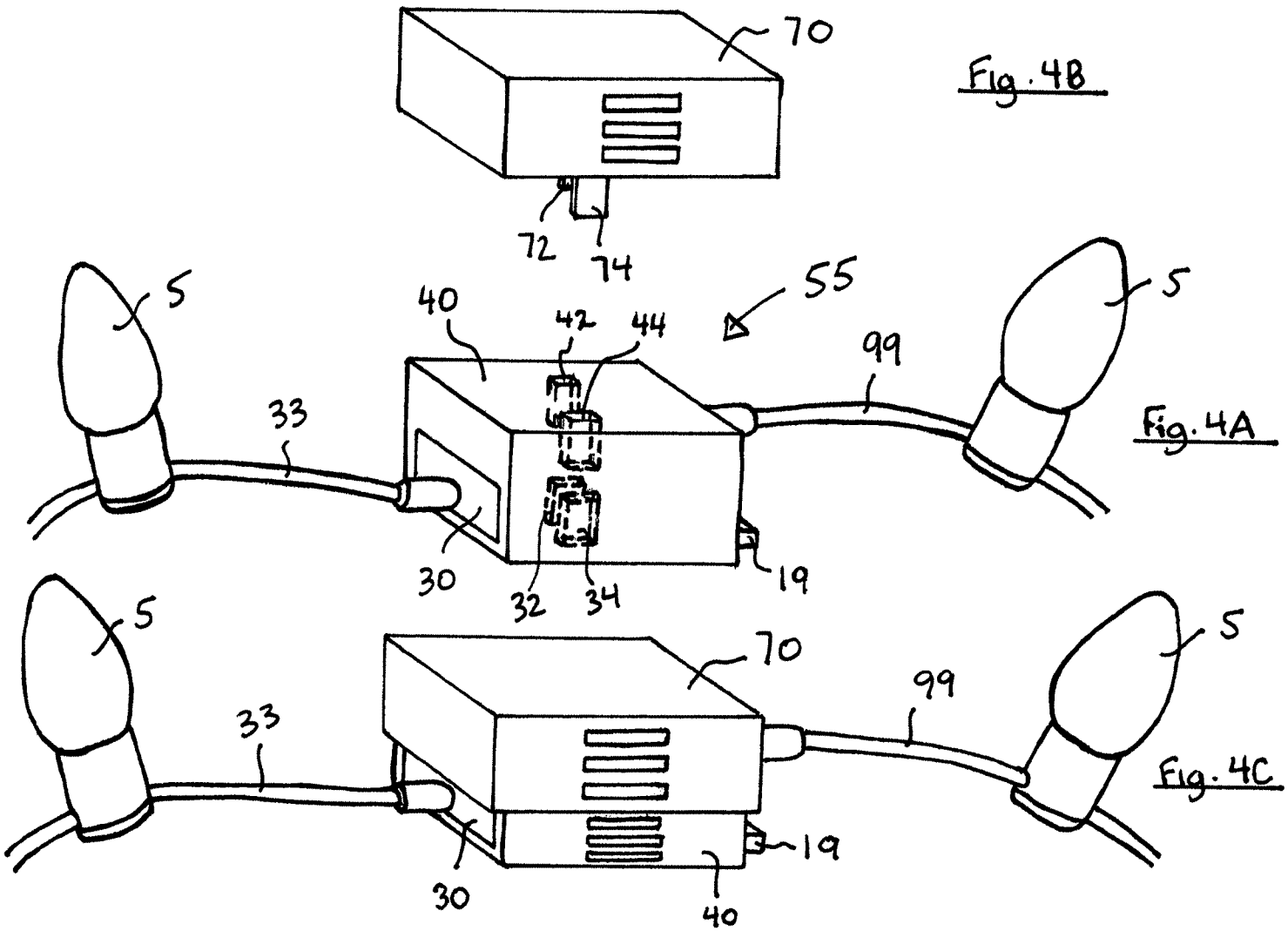
FIG. 4*a* shows the second embodiment female connector of one cord connected to the third embodiment female connector of another cord.
FIG. 4*b* shows a side perspective view of the first linking male fitting of FIGS. 2*d*-2*f*.
FIG. 4*c* shows the first linking male inserted into the aligned contact slots of the second and third female connectors.

FIG. 2*d*-2*f* shows an embodiment of a first linking male fitting 70 with a hot prong (blade) 72 and a neutral prong (blade) 74. The linking male fitting 70, comprises of a box-shaped housing, with a top and four sides. The hot prong 72 and the neutral prong 74 are secured to the top interior of the male fitting. The hot prong 72 and neutral prong 74 are longer than conventional prongs of a conventional male plug. When a second female connector 30 is inserted and aligned with the third female connector 40 of another cord, as shown in FIG. 4*a* the linking male fitting 70 can be inserted into the contact slots of both female connectors, to connectively link them together. A cord slot opening 87 is provided to clear the electrical cord of connector 40.

Figure 2G:
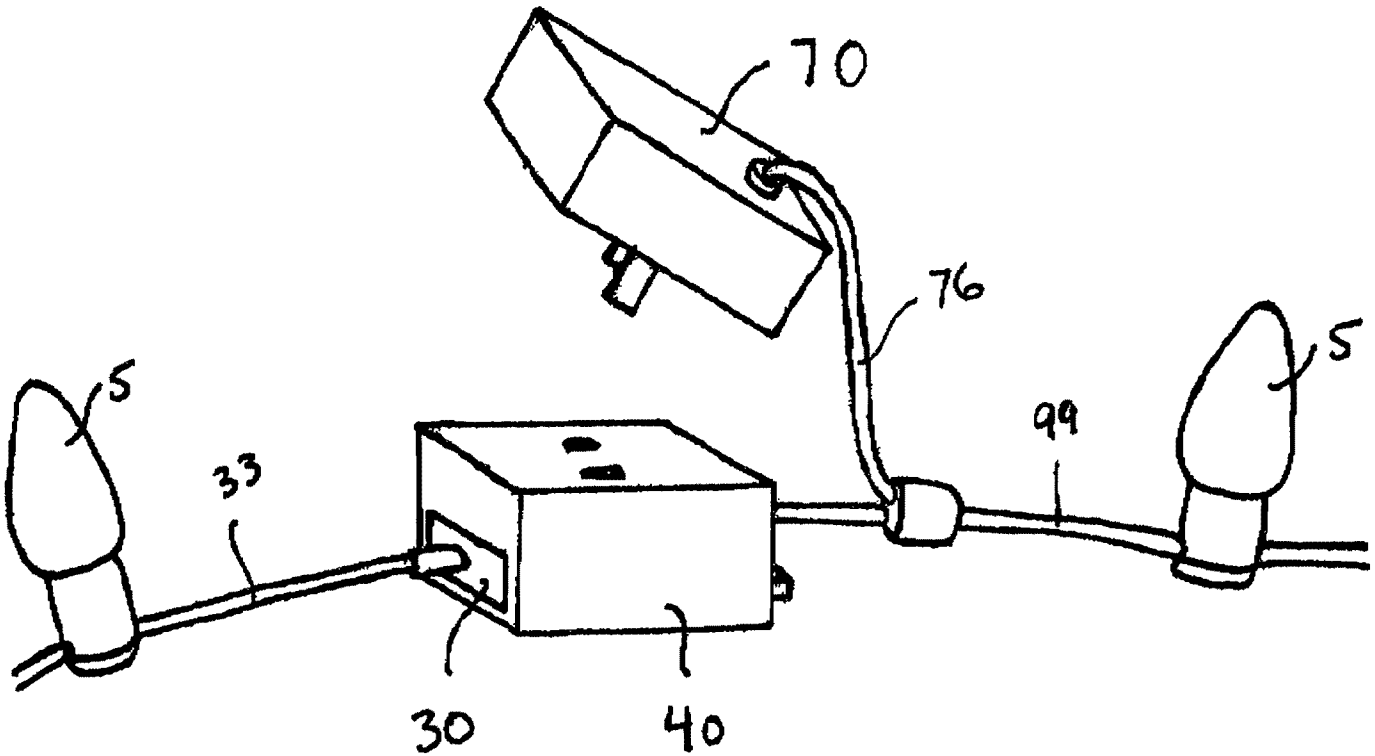
FIG. 2*g* shows a perspective view of two Christmas light strings, and a first linking male fitting attached on one end of one string of lights.

FIG. 2*g* shows that a first linking male fitting 71 can be attached by a non-electrical cord 76 or the like, connected on the end of the string of Christmas lights 5, for quickly and easily linking and connecting the aligned female connectors, 30 and 40, of cord 33 and 99, respectively. If the cord 99 is powered, the linking male fitting 71 and its prongs, will not be live until inserted into connector 40 of electrical cord 99.

An electrical cord or strings of lights can have ends with multiple second or third female connectors or a combination of both. For ease of access, various linking male fittings of the present invention can be secured to one end of the cord.

Figures of 1 and 2 can be designed with or without polarized connectors, and which can provide additional safety in operating the electrical cords and preventing physical injury.

For the purposes of this application, most references to male fittings, including linking and activating male fittings of the present invention, comprise of an open box-shaped housing with prongs, which when used correctly should prevent any physical contact with the hot and neutral prongs (blades) or any ground prong of a grounded connector, when an electrical connection is being made or disconnected. All male fittings in this application are not wired.

Figure 3:
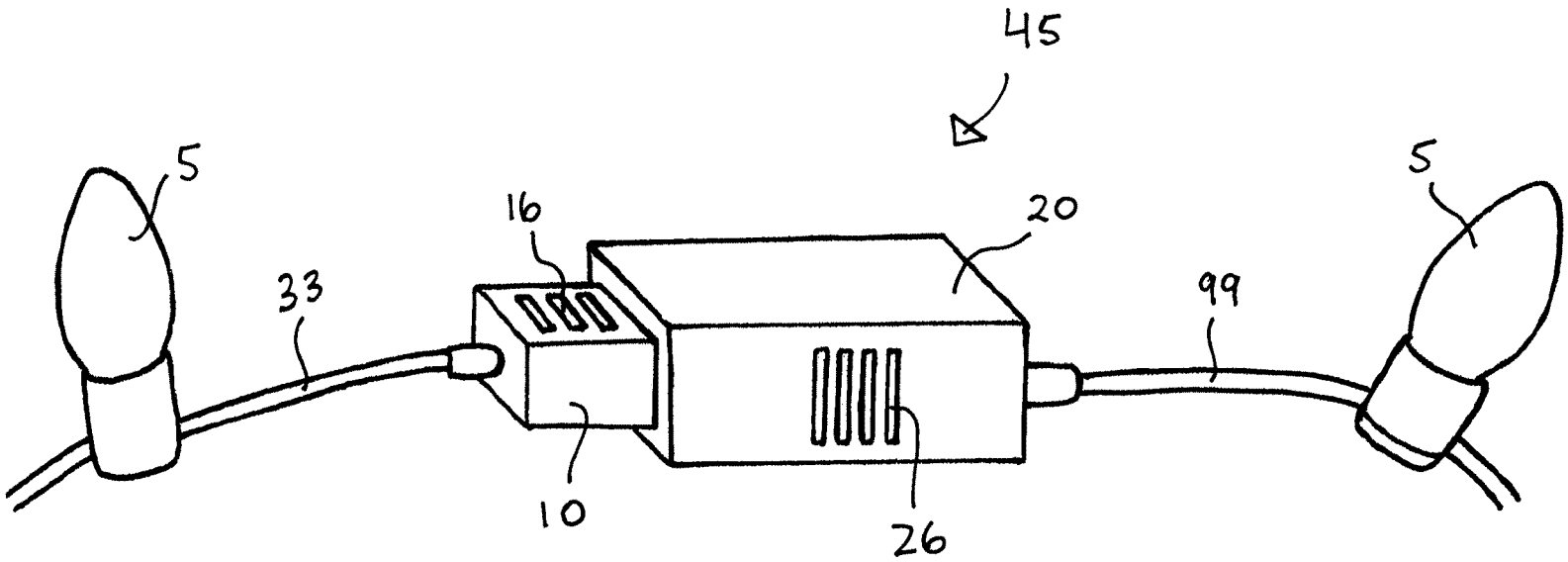
FIG. 3 shows the embodiments of the first female connector and first male connector of FIG. 1*a* of multiple cords, aligned together.

FIG. 3 shows the first female connector 10 of cord 33 of a string of Christmas lights 5, inserted into the receiving port of the first male connector 20 of cord 99 of another string of Christmas lights 5. An electrical connection 45 is formed, with the first female connector enters the receiving port of first male connector 20, and the contact prongs (blades) of connector 20 enter the contact slots of connector 10. First grips 16 of connector 10 and second grips 26 of connector 20 are shown. A power adapter 320 (shown in FIG. 6*a*) is needed to power up the electrical assembly of cords 33 and 99.

FIG. 4*a* shows Christmas lights 5 with the second female connector 30 of electrical cord 33 fully inserted and aligned in the receiving port of the third female connector 40 of electrical cord 99. The second female connector 30 slides into the third female connector 40 until it stops, aligning both connectors 55 and their electrical contact slots, for use with a linking male fitting 70, of FIG. 4*b*, to complete the connection and capping the connectors 55, as shown in FIG. 4*c*. The contiguous slots are formed by the aligned hot contact slot 32 with the hot contact slot 42, and by the aligned third neutral contact slot 34 with the third neutral contact slot 44. In FIG. 4*a*, the connectors are not linked together until a linking male fitting 70 (FIG. 4*b*) is utilized, capping the connectors 55 at FIG. 4*c*. A tap 19 on the end of connector 30, is shown exiting the back of connector 40, for separating the two connectors. A power adapter 330 of FIG. 6*b*, is required to power cords 33 and 99.

FIGS. 4*b* and 4*c* shows the first linking male fitting 70 of FIGS. 2*d*-2*f*, ready to be inserted into the aligned connectors 55 of FIG. 4*a*. via the hot prong (blade) 72 entering within the contiguous hot contact slots 42 and 32 and the neutral prong (blade) entering within the contiguous neutral contact slots 44 and 34. The connectors 55 are linked and connected when the first linking male fitting 70 caps the aligned connectors 55, as shown in FIG. 4*c*. An electrical power connection is formed when either end of connected cords 33 or 99, is connected to either corresponding female connector 30 or 40 of the power adapter 330, and then plugged into an electrical outlet or power source, and described in more detail in FIG. 6*b*.

Figure 5B:
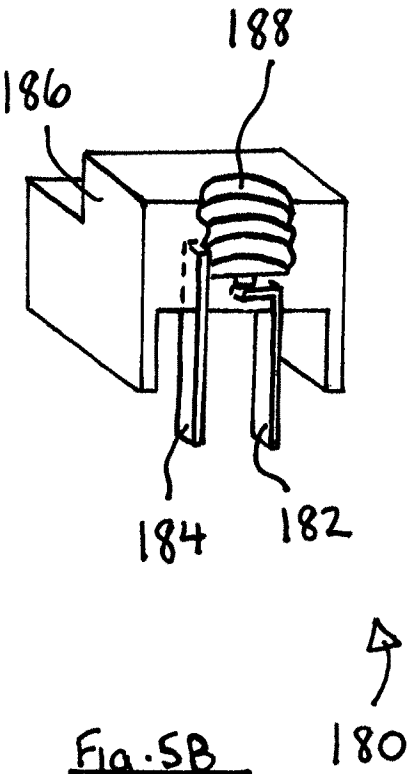
FIG. 5*b* shows a cross-sectional view of the second linking male fitting of FIG. 5*a*.
Figure 5A:
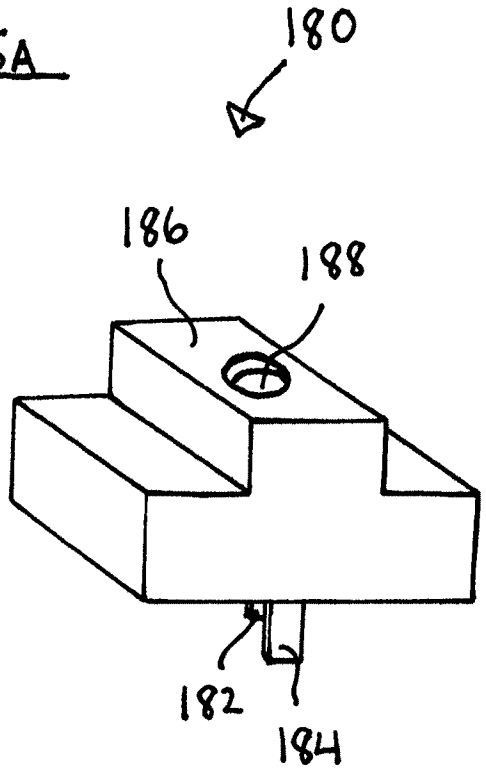
FIG. 5*a* shows a side perspective view of an alternative second linking male fitting with an additional component of a light socket connector cap.

FIG. 5*a* shows the second linking male fitting 180 comprising a hot prong (blade) 182, a neutral prong (blade) 184, additionally connected to a light socket 188 of the top cap 186 of the male fitting.

FIG. 5*b* shows a cutout view of the second linking male fitting 180, with the hot prong (blade) 182 and the neutral prong (blade) 184 connected to the bottom and side of the light socket 188, respectively, of the top cap 186.

Figure 5D:
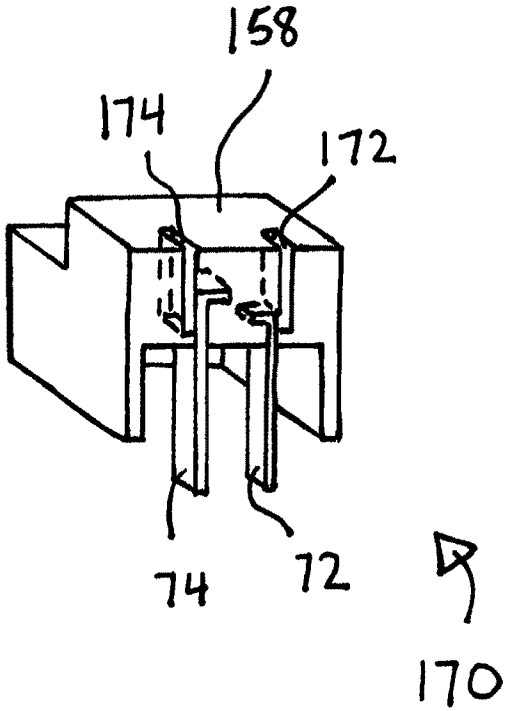
FIG. 5*d* shows a cross-sectional view of the third linking male fitting of FIG. 5*c*.
Figure 5C:
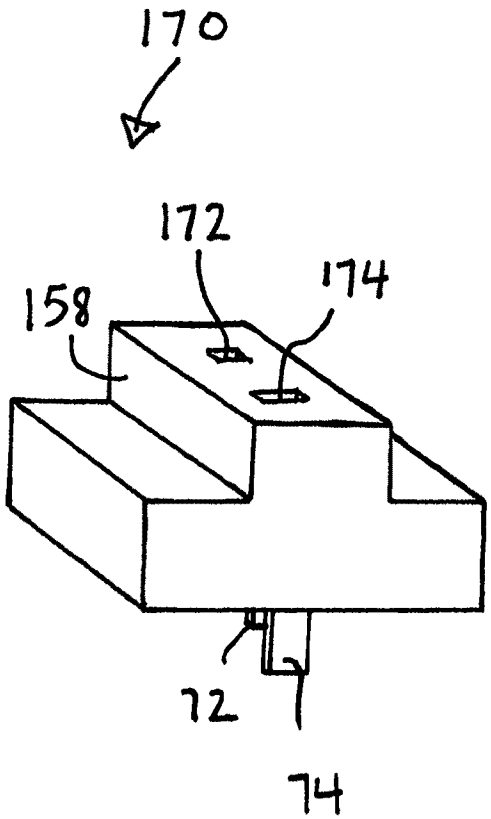
FIG. 5*c* shows a bottom perspective view of a third linking male fitting with an additional component of a female connector cap.

FIG. 5*c* and cutout view of FIG. 5*d*, shows a third linking male fitting 170 with a female connector cap 158 having a hot contact slot 172 and a neutral contact slot 174, which join connectively with a hot prong (blade) 72 and a neutral prong (blade) 74, respectively. It will be understood that this adaption of a female connector cap can be applied to all of the activating male fittings.

Figure 6A:
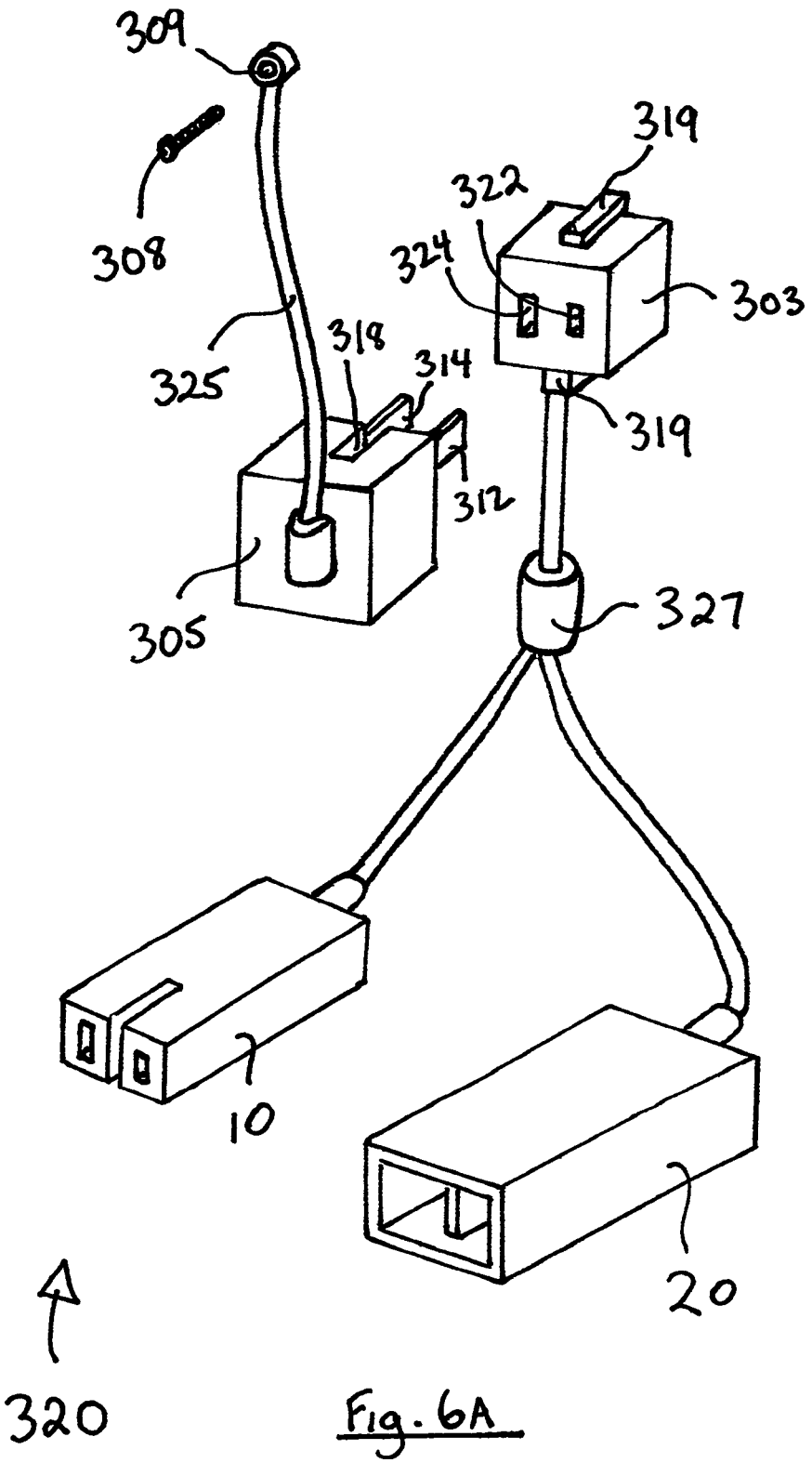
FIG. 6*a* shows a perspective view of a first embodiment of a power adapter cord comprising the first female connector and the first male connector of FIG. 1*a*, each connected to an electrical cord through a splitter, that is further connected to a fourth embodiment female connector for use with a detachable first activating male fitting.
Figure 6B:
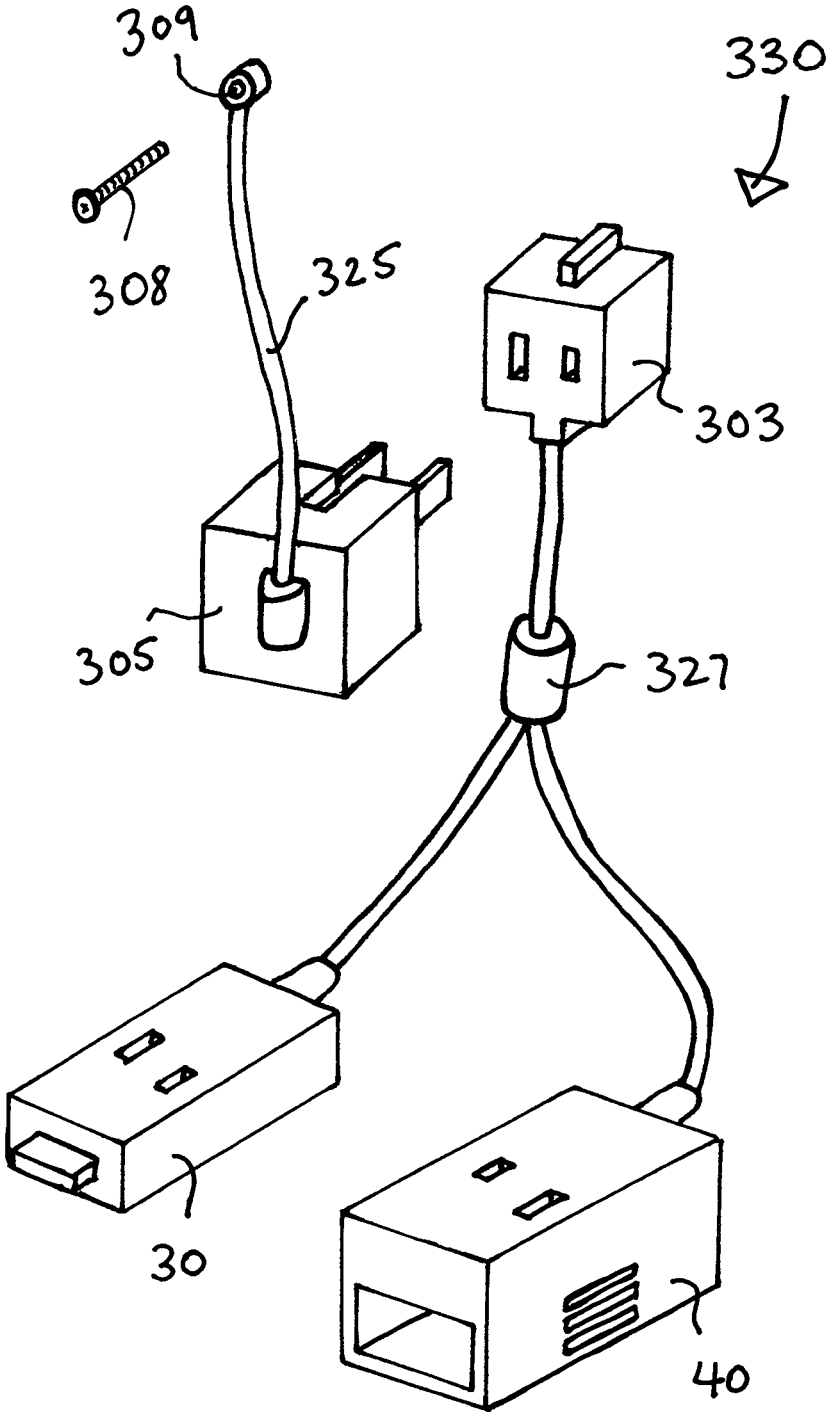
FIG. 6*b* shows a second embodiment of a power adapter cord comprising the second and third female connectors of FIG. 2*a*, each connected to a cord through a splitter, that is further connected to the fourth embodiment female connector of FIG. 6*a* and includes the first activating male fitting of FIG. 6*c* to power the adapter cord.

FIG. 6*a* shows a first embodiment power adapter cord 320 with a fourth female connector 303 electrically connected to a splitter 327, that splits to a connected first female connector 10 and a connected first male connector 20. The fourth female connector 303 includes a hot contact slot 322 and a neutral contact slot 324, that are continuous and open from the back of the connector 303, as shown in FIG. 6*d*. The adapter 320 also includes a first activating male fitting 305, includes a hot prong (blade) 312 and a neutral prong (blade) 314, for use with connector 303. The prongs (blades) of the activating male fittings form a conventional male plug when inserted into the fourth female connector 303. The power adapter cord 320 powers the string of Christmas lights 5 of FIG. 1*a*, regardless of which connector 10 or 20, is closest to the power outlet. The first activating male fitting 305, includes a slot opening 318, for grips 319 of connector 303, used to grab and disconnect both connector 303 and activating male fitting 305, when both are engaged or connected at the electrical outlet. The activating male fitting 305, includes and connects to one end of a strap 325, and the other free end of the strap, includes a mount with mounting hole 309, for a screw 308. The first activating male fitting 305, acts as a safety feature by connecting directly to an outdoor cover and/or to a receptacle/power outlet 128. The strap 325, when used correctly, tries to prevent using a power adapter at both ends of the Christmas light assembly, to avoid a hazard of creating a male plug at both ends. A conventional male plug can be used to replace the fourth female connector 303 and the first activating male fitting 305, of the power adapter 320, but may not be as safe in avoiding a male plug at both ends of the assembly, if an adapter were attempted to be used at both ends.

FIG. 6*b* shows a second embodiment power adapter cord 330, and includes a fourth female connector 303 electrically connected to a splitter 327, that splits to a connected second female connector 30 and a connected third female connector 40., and further includes a first activating male fitting 305, for use with connector 303. The power adapter cord 330 powers the string of Christmas lights 5 of FIGS. 2*a* and 4*c*, regardless of which end of the lights, or connector, 30 or 40, is closest to the power outlet. Again, the activating male fitting 305 includes a strap 325, connected the fitting, and the other free end of the strap, includes a mount with mounting hole 309, for securing the strap using screw 308.

FIG. 6*c*-6*f* shows the first activating male fitting 305 and the fourth female connector 303 of power adapter cords 320 and 330 of FIGS. 6*a* and 6*b*, respectively. FIG. 6*c* shows the front of the fourth female connector 303 and the back of the first activating male fitting 305, with a hot prong (blade) 312 and neutral prong (blade) 314 of power adapters 320 and 330, of FIGS. 6*a* and 6*b*, respectively. The fourth female connector 303 includes a hot contact slot 322 and a neutral contact slot 324, with the contact slots being continuous and open from the back of the connector 303 (as shown in FIG. 6*d*).

FIG. 6*d* shows a perspective view of the back of the fourth female connector 303, with the hot contact slot 322 and neutral contact slot 324, continuous and open from the back, as well as in the front of the connector, as shown in FIG. 6*c*.

FIG. 6*e* shows the front of the first activating male fitting 305, that mounts over the fourth female connector 303, of FIG. 6*c*, when powering up either adapter, 320 or 330, at a power source, showing the hot prong (blade) 312 and the neutral prong (blade) 314.

FIG. 6*f* shows a side perspective view of the first activating male fitting 305 with a hot prong (blade) 312 and a neutral prong (blade) 314, inserted into the fourth female connector 303, of either adapter cords 320 and 330, of FIGS. 6*a* and 6*b*, respectively. Grips 319 allow removal of both connector 303 and activating fitting 305 from a power source when connected, and also makes separation from each other easier. Strap 325 of the first activating fitting is also partly shown.

Figure 7B:
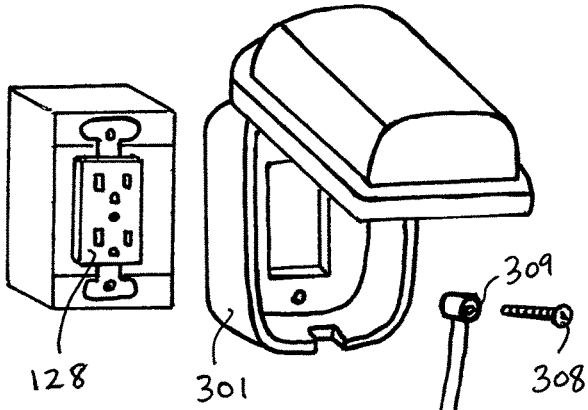
FIG. 7*b* shows a perspective view of an outdoor electrical box with a receptacle, an outdoor weatherproof cover, and the first activating male fitting.
Figure 7A:
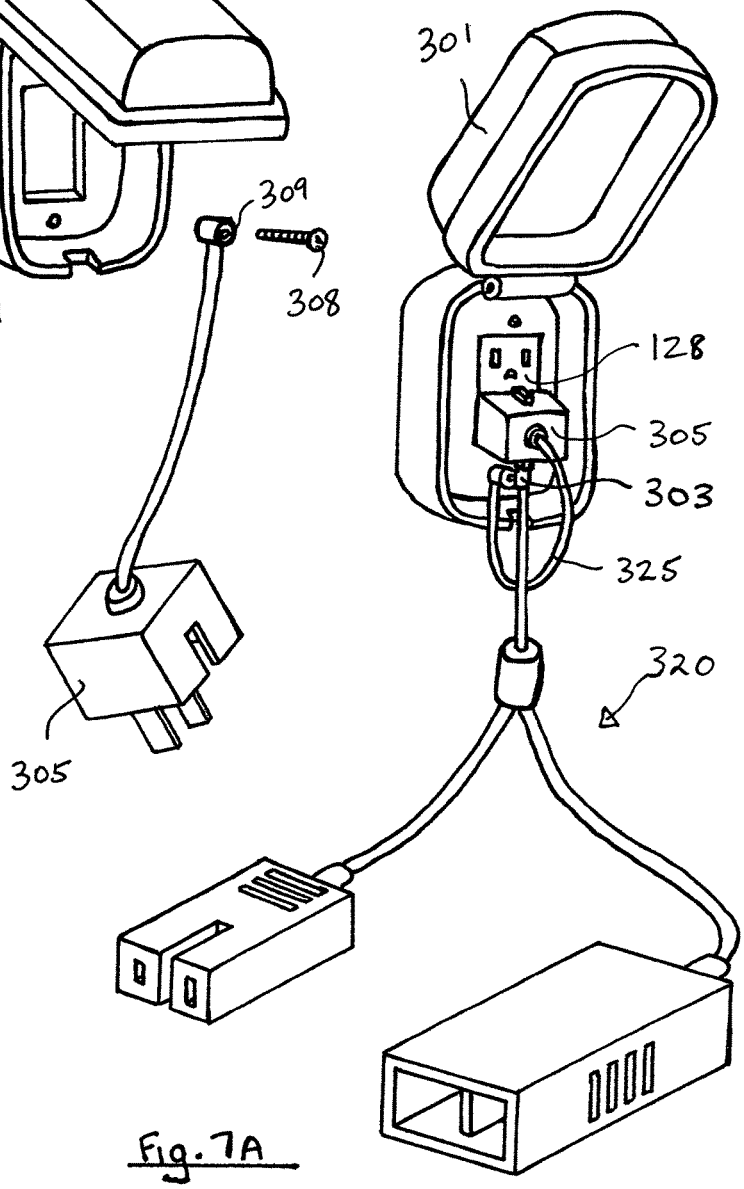
FIG. 7*a* shows the first embodiment power adapter cord with activating male fitting strap, connected to the weatherproof cover and electrical receptacle, and the fitting plugged into the outdoor electrical receptacle of FIG. 7*b*.

FIG. 7*a* shows a main power adapter 320 of FIG. 6*a*, that is used to power Christmas lights 5, of cords 33 and 99 of FIG. 3. The power adapter 320 is plugged into an electrical power receptacle 128, using the first activating male fitting 305 inserted into the fourth female connector 303. The first activating male fitting includes a safety strap 325 that is secured to an outdoor electrical outlet, which can include the receptacle 128 and/or weatherproof cover 301.

FIG. 7*b* shows an outdoor electrical box with receptacle 128, an outdoor weatherproof cover 301, and the first activating male fitting 305, with strap 325, that can secure to the cover 301 and/or receptacle 128, using mount 309 on the end of the strap 325, using screw 308.

Figure 8:
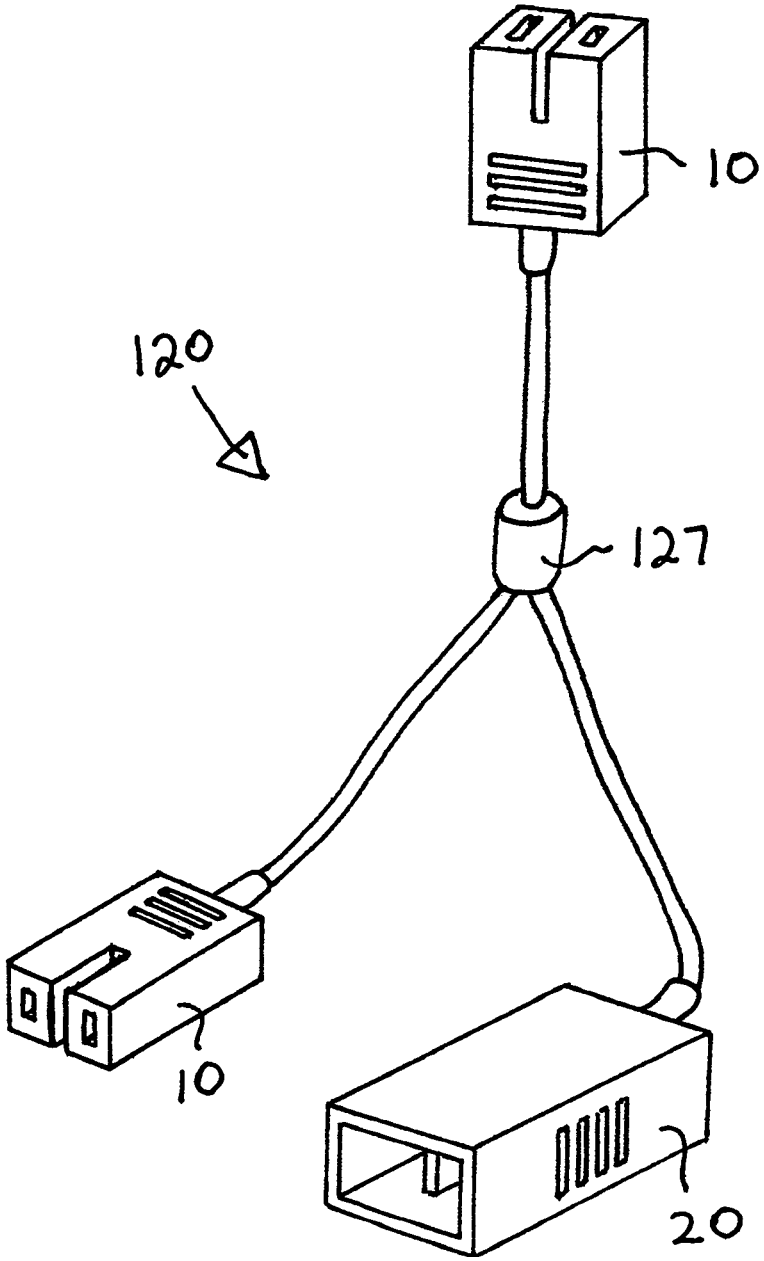
FIG. 8 shows a first embodiment of a splitter adapter of the present invention comprising the first female and first male connectors from FIG. 1*a*, connected to a splitter, that is connected to a further first female connector from FIG. 1*a*.

FIG. 8 shows a first embodiment of a splitter adapter cord 120, with a first female connector 10, which is attached by an electrical cord to a splitter 127, that splits to two additional cords, one connected to a further first female connector 10, and the other connected to a first male connector 20. The splitter adapter 120, for use with a string of lights of figure of FIG. 1, allows additional cords to be connected and installed in different directions.

Figure 9:
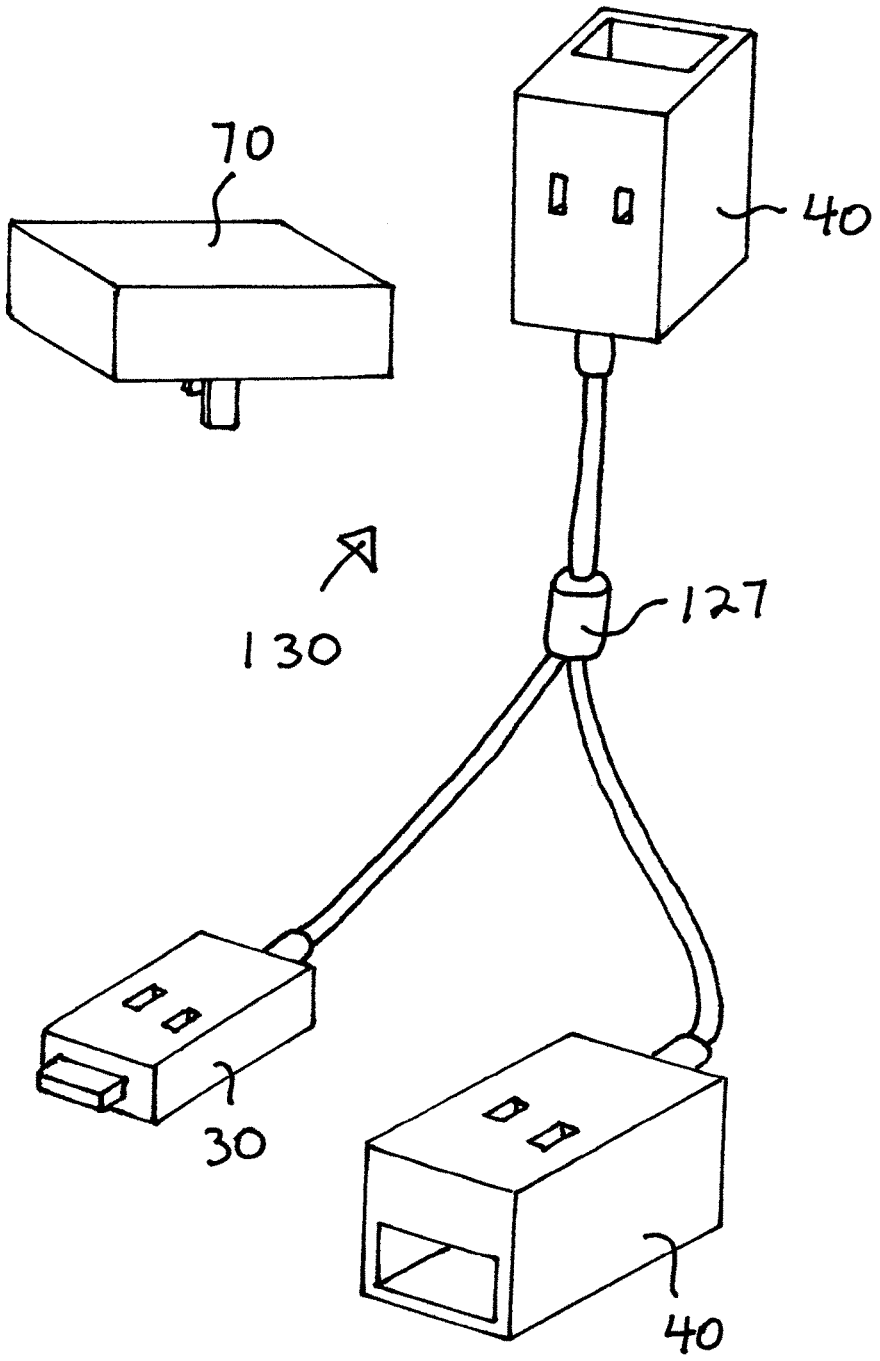
FIG. 9 shows a second embodiment splitter adapter comprising the second female connector and the third female connector from FIG. 2*a*, connected to a splitter, that is connected to a further third female connector of FIG. 2*a*.

FIG. 9 shows a second embodiment of a splitter adapter cord 130, with a third female connector 40, attached by an electrical cord to a splitter 127, that splits to two additional cords, one connected to a second female connector 30, and the other connected to a further third female connector 40. The splitter adapter 130 allows cords to be run off in different directions. A linking male fitting 70 is used to connect the splitter adapter to one of the connectors of the electrical cord of FIG. 2*a*. The splitter adaptor 130, allows additional cords to be connected and installed in different directions.

FIGS. 10 and 11 show a light socket clip, used for various light strings, including Christmas lights.

Figure 10A:
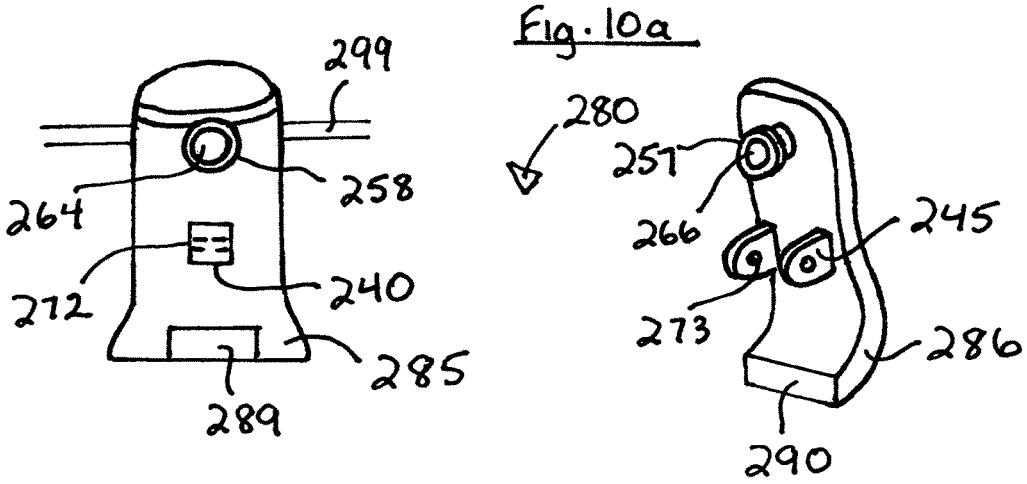
FIG. 10*a* shows a front perspective view of two halves of a first embodiment light socket clip.

FIG. 10*a* shows two halves of a first embodiment of a light socket clip 280, connected to an electrical cord 299 (partly shown), and an elongated body member 286. The light socket 285 includes an exterior housing with mount 240, having a pivot mounting hole 272. The elongated body member 286, includes mounting members 245, each having a pivot mounting hole 273, for aligning and securing to the mount 240, with the retaining pin 274, of FIG. 10*b*. The exterior of the light socket 285 includes a spring housing 264 near the top of the housing, directly above the mount 240, for retaining and securing one end of a compression spring 260, of FIG. 10*b*.

The elongated body member 286 includes the other half of the spring retaining housing 266, for retaining and securing the other end of the compression spring 260. The spring retaining housing 264 and 266 of the light socket 285 and the elongate member 286, respectively, can optionally include an external outer lip 258 and 257, respectively, for mounting of the rubber boot 261, of FIG. 10 *b*, used to protect and cover the spring. The light socket 285 and the elongated body member 286, each including a gripping portion (jaw 289 and 290, respectively, and directly below the housing mount 240 located at the base of the light socket.

Figure 10B:
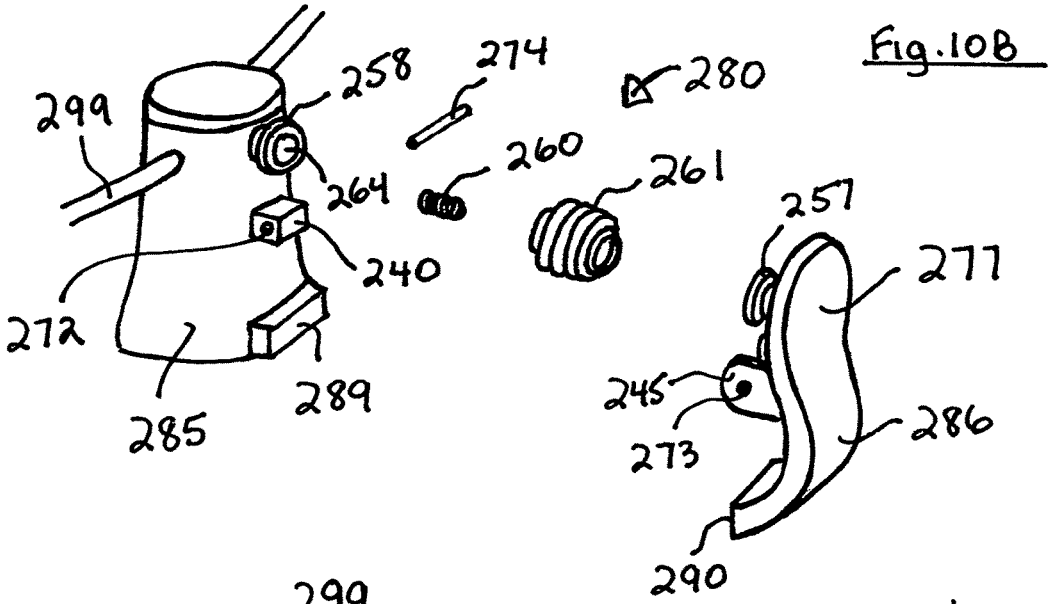
FIG. 10*b* shows an exploded view of the first embodiment light socket clip.

FIG. 10*b* shows an exploded view of the light socket clip 280 and its component parts. One end of a compression spring 260, mounts and secures to the spring retaining housing 264 of the light socket 285, and to the other end of the compression spring, mounts and secures to the spring retaining housing of the elongated body member 286. The rubber boot 261, is installed over the outer lips 258 and 257 of the spring retaining housings of the light socket and elongate member, respectively. The retaining pin 274 secures the two mounting members 245 of the elongated body member 286 to the housing mount 240 of the light socket 285, using pivot holes 273 and 272, respectively. The elongated body member 286 includes a finger grip 277 at the top exterior, and the light socket 285 is electrically wired to cord 299.

Figure 10C:
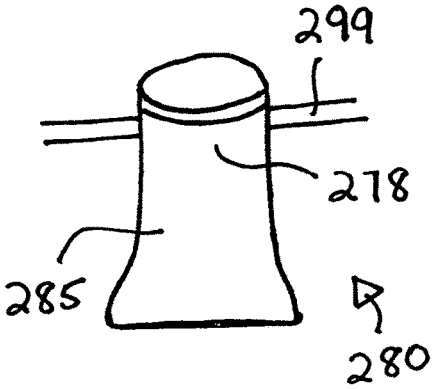
FIG. 10*c* shows a perspective back view of the first embodiment light socket clip of FIG. 10*b*.

FIG. 10*c* shows the back of the light socket 280 and the wired electrical cord 299 (partly shown). A grip 278 is shown near the top of the light socket 285.

Figure 10D:
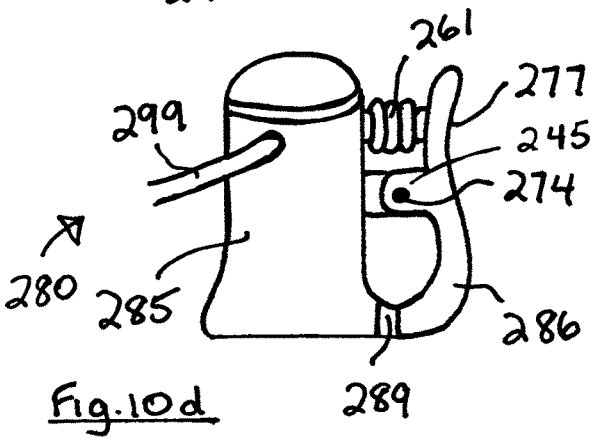
FIG. 10*d* shows a side perspective view of the light socket clip of FIG. 10*b*.

FIG. 10*d* shows a side view of the light socket clip 280 showing the light socket 285 connected to the elongated member 286. The retaining pin 274, retaining the mounting members 245 to the mount 240 of the light socket housing. A rubber boot 261, mounting to the outer lips of the spring retaining housings, covers the compression spring 260. A side view of the socket gripping portion (jaw) 289 is seen, and a side view of the finger grip 277 of the elongated member 286, is also shown.

Figure 11A:
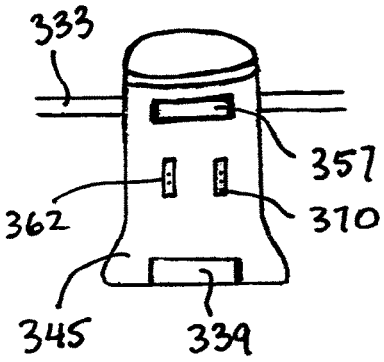
FIG. 11*a* shows a front perspective view of the two halves of a second embodiment light socket clip.

FIG. 11*a* shows two halves of a second embodiment light socket clip 390, including a light socket 345 connected to electrical cord 333 (partially shown), and an elongated body member 346. The light socket 345 includes an exterior housing with mounting members 370, each having a pivot mounting hole 362. The elongated body member 346 includes mounting members 371, each with pivot mounting holes 363, aligning with the pivot mounting holes 362, for connecting to the light socket 345, using a retaining pin 364 of FIG. 11*b*. The light socket further includes a slot groove 357 near the top and directly above the two mounting members 370, for securing one of the arms of the torsion spring 360 of FIG. 11*b*, and a jaw or gripping portion 339 directly below the two mounting members 370 located at the base of the light socket 345.

The elongated body member 346 includes a slot groove 358 near the top and directly above the two mounting members 371, for securing the other arm of the torsion spring, and also includes a jaw or gripping portion 340, directly below the mounting members 371.

Figure 11B:
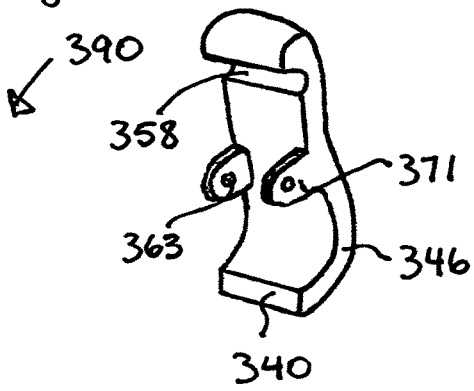
FIG. 11*b* shows an exploded view of the second embodiment light socket clip.
Figure 11B:
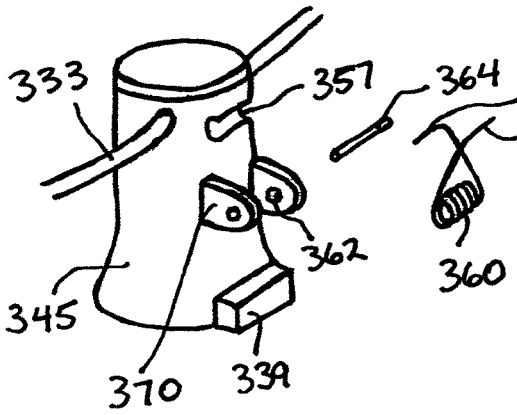
Figure 11B:
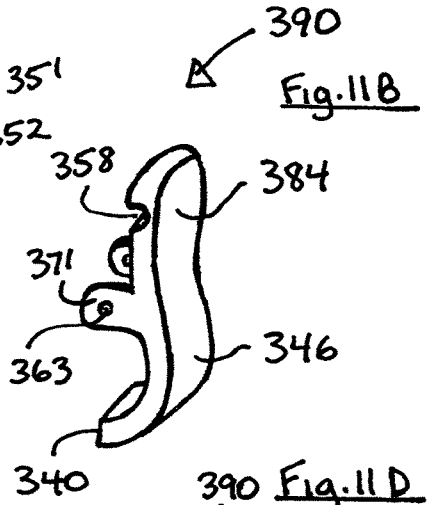

FIG. 11*b* shows an exploded view of the light socket clip 390 and its component parts. A torsion spring 360 is meant to slide between the two mounting members 370 of the light socket 345, with one arm 351 of spring 360 resting or securing to the slot groove 357 of the light socket 345 and the other arm 352 of the torsion spring 360 resting or securing to the slot groove 358 of the elongated body member 346. The mounting members 371 of the elongated body member 346, connects to the two mounting members 370 of the light socket 345. A retaining pin 364 enters the mounting hole 363 of the elongated body member 346 then mounting hole 362 of the socket housing 345, through the opening of the torsion spring 360, again through mounting hole 362 and finally to the other mounting hole 363 of the elongated body member. The light socket 345 is electrically connected to electrical cord 333. A grip 384 is provided on the top exterior of the elongated member 346, to operate the clip by gripping the elongate member and the exterior housing of the light socket. A light socket includes a grip or jaw 339 at the base of the socket 345 directly below the two mounting members and a contact grip (jaw) 340 is provided with the elongated member 346, for clipping to an object.

Figure 11C:
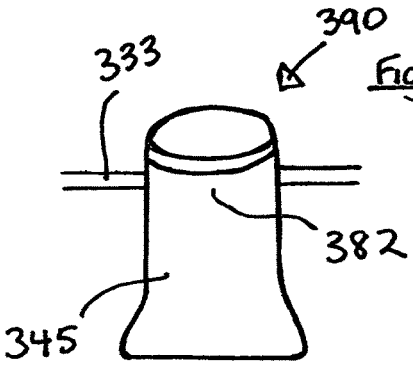
FIG. 11*c* shows a perspective back view of the second embodiment light socket clip of FIG. 11*b*.

FIG. 11*c* shows the back of the light socket clip 390 wired to an electrical cord 333 (partly shown). A finger grip 382 is shown near the top of the light socket 345.

Figure 11D:
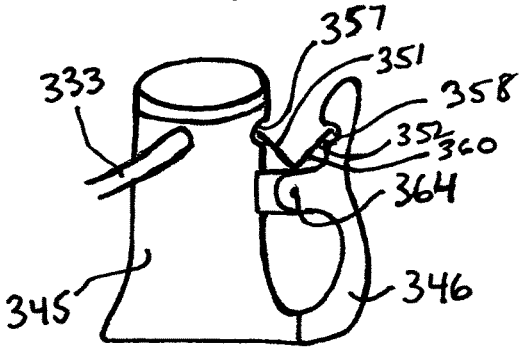
FIG. 11*d* shows a side perspective view of the light socket clip of FIG. 11*b*.

FIG. 11*d* shows a side view of the light socket clip 390 connected to electrical cord 333. The retaining pin 364 secures the torsion spring 360, the light socket 345, and the elongated body member 346 together. The spring arm 351 secures or rests on slot groove 357 of the light socket 345, and the spring arm 352 secures or rests on the slot groove 358 of the elongated body member 346.

It will be understood, that both light socket clips of FIGS. 10 and 11, can be used for other lighting applications, not just Christmas lights. The light socket housing and the elongated body member can have various shaping, ie straight and flat, or a rounded design, or a combination of both, to provide the proper clipping action required, for various applications.

References to "housing" refer to the appropriate molded and accessible housing combination that may be used in the invention depending on the need to access the electrical receptacle.

FIGS. 12 and 13 refer to an adaptable replacement connector having internal parts that are common to both the male and female replacement connector, which includes the internal housing and the electrical contacts with wire terminals. FIG. 12 refers to a male replacement connector, and FIG. 13 refers to a female replacement connector.

FIG. 12 shows a first adaptable male replacement connector 110 with a replaceable cover 100, a mounting base 90 an inner housing 98, and electrical contacts with wire terminals, including a hot contact with terminal 102, a neutral contact with terminal 104 and ground contact with terminal 106, all housed in the corresponding slots 92, 94 and 96, of the inner housing, respectively. A mounting base 90 includes body members 139, for providing a slot to position and secure the inner housing and the electrical contacts. The mounting base 90 includes slot openings 82, 84 and 86, corresponding to a hot prong (blade) 112, a neutral prong (blade) 114, and a ground prong 116 of a male replacement cover 100, respectively. The mounting base 90 also provides threaded cylinders 123 and a threaded bore 124 for the male replacement cover 100, to secure to, using the mounting holes 133 on the top and mounting hole 134 on the end, respectively, with screws 126 and 128, respectively. The outside surface of the mounting base 90 includes a extending member 87 for the hot prong (blade) 112, neutral prong (blade) 114 and ground prong 116 of the male replacement cover, to provide them with extra support. Both the mounting base 90 and the replacement cover 100, include a slot 135 for the cord inserts 136. The cord inserts 136 are reversible, and include a top rounded edge 118 and a bottom rounded edge 119, for use with either a big gauge electrical cord or a smaller gauge electrical cord, respectively. The cord slots 135 and the cord inserts 136, provide the entry for the electrical cord to be wired to the male replacement connector 110. The electrical contacts 102, 104 and 106 and inner housing slots 92, 94 and 96, are continuous and open from the back, allowing the hot prong (blade) 112, the neutral prong (blade) 114 and the ground prong 116 to enter the contact slots with electrical contacts, and then exit out the mounting base 90. The connector provides easy replacement of the cover if any of the prongs become damaged without requiring any rewiring.

The slot openings of the mounting base 90 can be provide with guides or bevels, to guide the ends of the prongs out the contact slot openings and can provides a tight fit of the blades or prongs, similar to conventional plugs.

FIG. 12*b* shows the mounting cover 100 of the male replacement connector, with hot prong 112, the prong 114 and ground prong 116.

FIG. 12*c* shows the male replacement connector 110, with the mounting cover 100 mounted and secured to mounting base 90 and connected to an electrical cord, and with hot prong 112, neutral prong 114 and ground 116 exiting the mounting base. Cord inserts 136 are shown at the cord end of the connector.

Figure 12A:
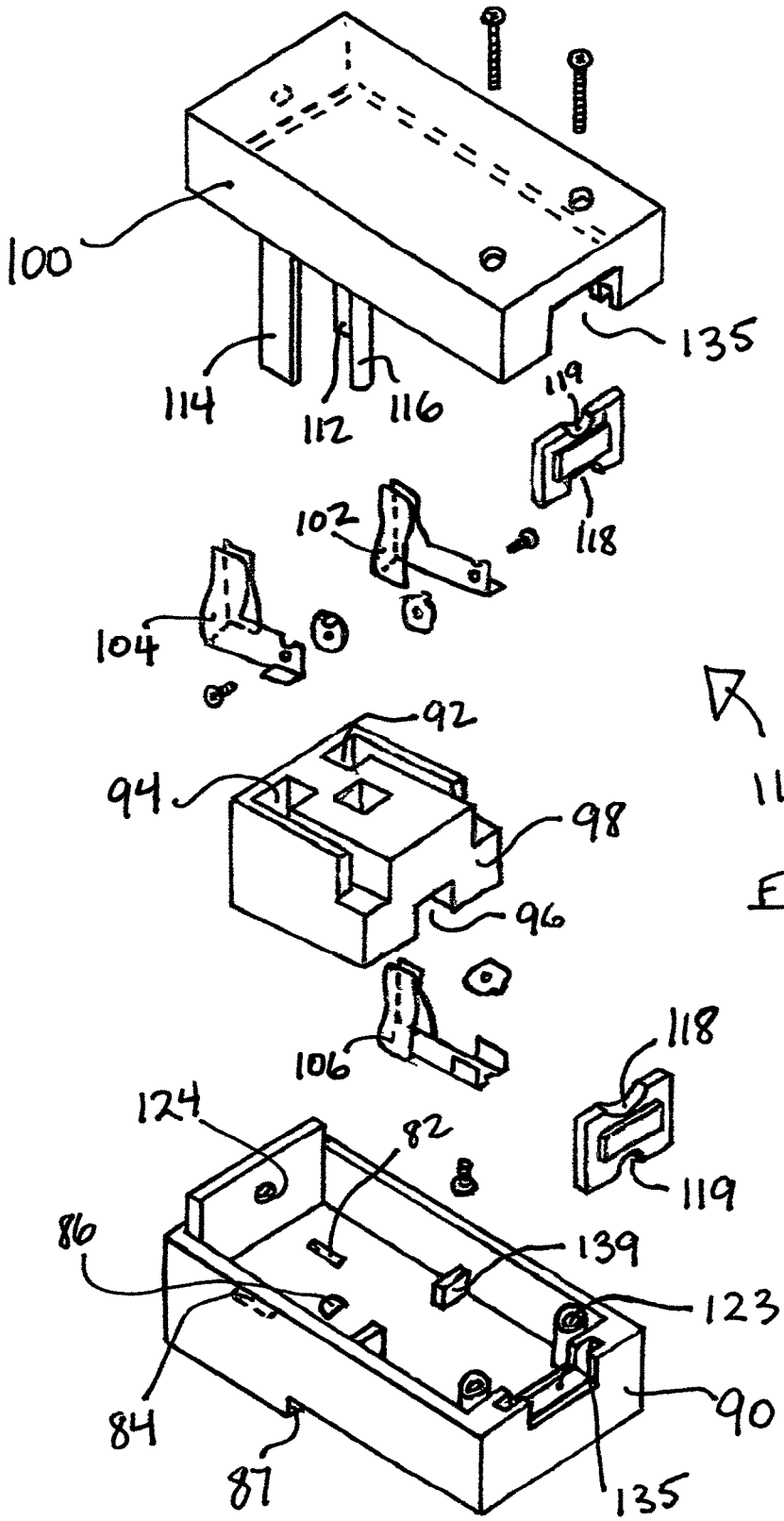
FIG. 12*a* shows an exploded view of a first adaptable replacement male connector, including a removable male cover with prongs and a removable first mounting base.
Figure 13B:
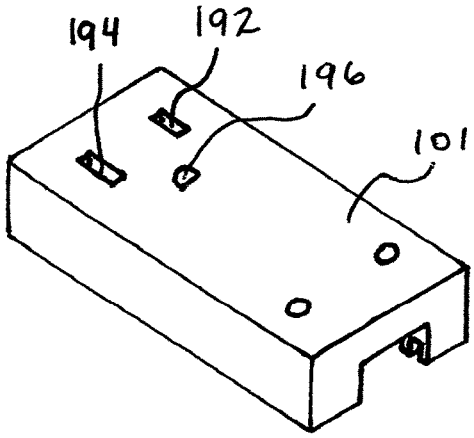
FIG. 13*b* shows a perspective view of the inside of the female cover of FIG. 13*a*.
Figure 13A:
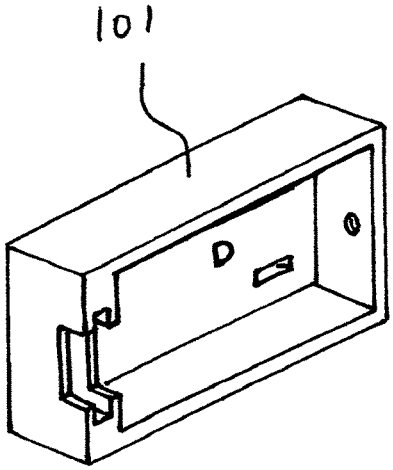
FIG. 13*a* shows a perspective view of a female receptacle cover with a second mounting base for use with the first adaptable replacement connector of FIG. 12*a*.
Figure 13A:
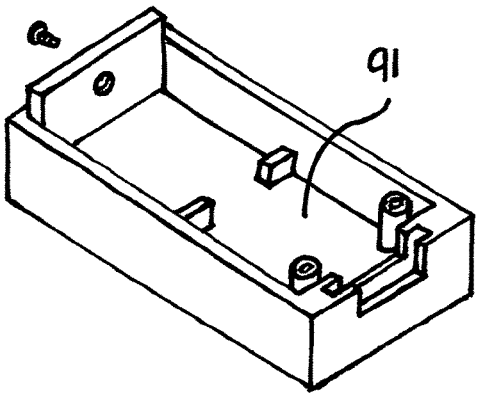
Figure 13C:
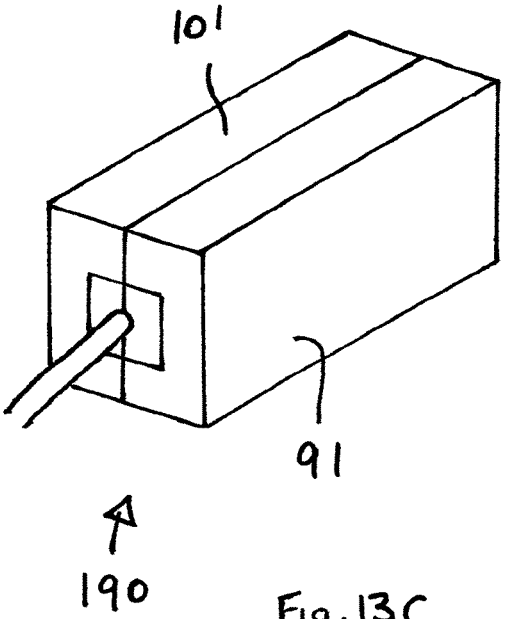
FIG. 13*c* shows the adaptable female replacement connector with cover and mounting base connected to an end of an electrical cord.

FIG. 13*a* shows the female replacement cover 101, and mounting base 91 of the adaptable female replacement connector of FIG. 13*c*. The cover 101, having contact openings 192, 194 and 196, that correspond with the hot contact 102, the neutral contact 104 and the ground contact 106, of an inner housing 98, as shown in FIG. 12*a*. The mounting base 91 has no slot openings as as compared to the male mounting base of FIG. 12*a*.

FIG. 13*b* shows a perspective view of the inside of the adaptable female replacement cover 101.

FIG. 13*c* shows an adaptable female replacement connector 190 wired to an electrical cord, with both the replacement cover 101 and mounting base 91 secured to each other in the same way as the adaptable male replacement connector of FIG. 12.

Both adaptable replacement connectors of FIGS. 12 and 13 can additionally be colored coded for ease of recognizing a connector meant for either a male replacement connector or female replacement connector. Also, both adaptable replacement connectors of FIGS. 12 and 13 can be applied for various applications, or connectors, including a connectors with or without a ground prong, a connector with more than two prongs, or a connector for more than one hot contact.

Figure 14A:
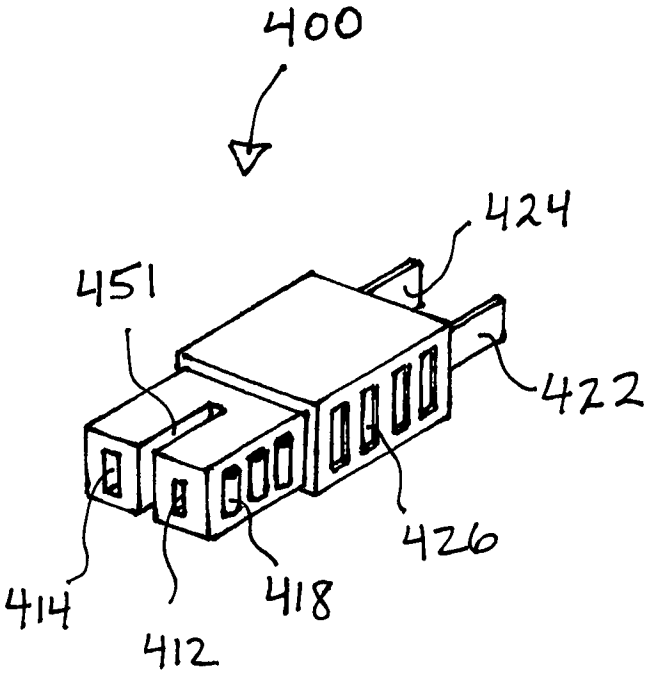
FIG. 14*a* shows a back side perspective view of an embodiment of a first connector adapter.
Figure 14B:
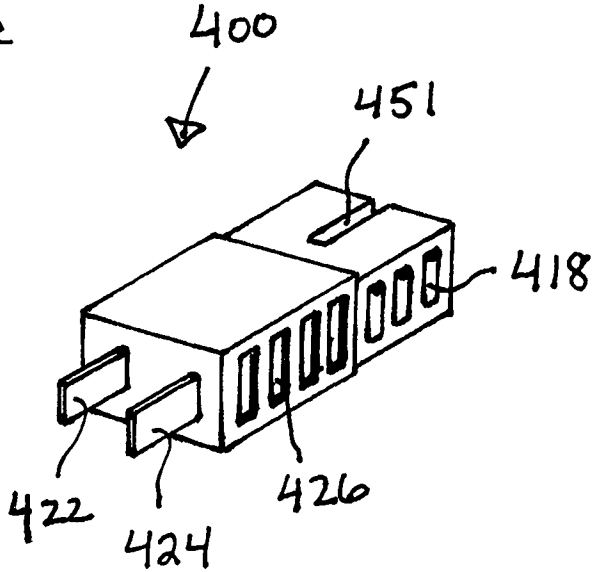
FIG. 14*b* shows a front side perspective view of the first embodiment connector adapter of FIG. 14*a*.

FIGS. 14*a* and 14*b* shows a first embodiment connector adapter 400 comprising a female connector end and a male connector end of the first female connector 10 and first male connector 20 of FIG. 1*a* respectively, connected and linked together.

FIG. 14*a* shows a perspective view of the back of the adapter 400 with a female connector end comprising a hot contact slot 412 and a neutral contact slot 414, connected to the hot prong 422 and the neutral prong 424, respectively, of the male connector end, shown in a front view in FIG. 14*b*. The female connector end includes slot 451 in the housing between the hot and neutral slots. Slot 451 corresponds to partition tab 53 of the first male connector 20 of FIG. 1*a*. The adapter also includes grips 418 on the sides of the female end, for gripping the insides of the receiving port of the first male connector 20 when connected together. The male connector end includes grips 426 for gripping the adapter when disconnecting it from a first female connector 10 or when unplugging it from an electrical outlet or electrical cord.

It will be understood that the figures show no contact slot for a ground in some examples and a contact slot for a ground in other examples, and it will be understood that either can be used depending on the needs. As well, just as with conventional cords, the connectors of the present invention can be for interior or exterior use. It will also be understood that the prongs and contact slots can be adapted depending on the country's electrical conventions/needs, and the examples show North American standards just for illustration purposes, but the invention is not limited to the same.

The receptacle of the various female can include contact slots of various design, spacing, size and depth, and can be staggered, for use and matching to the design, spacing, size and length of the blade/prongs of its corresponding male connector or fitting.

The Christmas lights string connectors and various adapter connectors, can be of sizes, including sizes able to accept and connect with conventional connectors, and designed with safety in mind, The electrical cords can vary in length, and have various components. The wiring, connector ends, fittings and adapters can be for a two or more prong circuit, with or without a ground wire, and designed for use in multiple countries and for the specific voltage used in those countries.

The connectors of the present invention can be used for both interior or exterior electrical cords, including light strings that various numbers of incandescent bulbs, or light-emitting diodes (LEDs), or cords with ornamental lights.

A sleeve cover can be installed over any connector when not in use to protect from damage.

While embodiments of the invention have been described in the detailed description, the scope of the claims should not be limited by the preferred embodiments set forth in the examples, but should be given the broadest interpretation consistent with the description as a whole.

The applicants, inventors or owners reserve all rights that they may have in any invention disclosed in an apparatus or process described above that is not claimed in this document. For example, the right to claim such an invention in a continuing application and do not intend to abandon, disclaim or dedicate to the public any such invention by its disclosure in this document.

What is claimed:

1. An electrical assembly comprising:

a cord set comprising:

a first electrical cord, a first female connector electrically connected to one end of the first electrical cord; and a first male connector electrically connected to the other end opposite the one end of the first electrical cord;

wherein the first female connector includes a housing enclosing an electrical receptacle, the housing including a hot slot and a neutral slot, the electrical receptacle including a hot contact with terminal and a neutral contact with terminal, the hot contact with terminal disposed in the hot slot, the neutral contact with terminal disposed in the neutral slot, the hot terminal and the neutral terminal electrically connected to the corresponding wires at the one end of the first electrical cord;

wherein the first male connector includes a housing enclosing a hot prong with terminal and a neutral with terminal, the hot terminal and the neutral terminal electrically connected to the corresponding wires at the other end of the first electrical cord, the housing of the first male connector further including a receiving port in which the hot prong and neutral prong are disposed at a distance from an open end of the receiving port; and an adapter comprising:

a second electrical cord;

a second female connector electrically connected to one end of the second electrical cord:

wherein the second female connector includes a housing enclosing an electrical receptacle, the housing including a hot slot and a neutral slot, the electrical receptacle including a hot contact with terminal and a neutral contact with terminal, the hot contact with terminal disposed in the hot slot, the neutral contact with terminal disposed in the neutral slot, the hot terminal and the neutral terminal electrically connected to the corresponding wires at the one end of the second electrical cord; and a male plug electrically connected to the other end opposite the one end of the second electrical cord, wherein the male plug includes a housing for a hot prong with terminal and a neutral prong with terminal, the hot terminal and the neutral terminal enclosed in the housing and electrically connected to the corresponding wires at the other end opposite the one end of the second electrical cord:

wherein the receiving port of the first male connector is shaped to receive a female connector or another cord set or adapter;

wherein the electrical assembly receives power when the second female connector of the adapter is connected to the first male connector of the cord set and the male plug is plugged into an electrical outlet.

2. The electrical assembly of claim 1, wherein the adapter further comprises:

a third electrical cord;

a second male connector electrically connected to one end of the third electrical cord;

wherein the second male connector includes a housing enclosing a hot prong with terminal and a neutral prong with terminal, the hot terminal and the neutral terminal electrically connected to the corresponding wires at the one end of the third electrical cord, the housing of the second male connector further including a receiving port in which the hot prong and neutral prong are disposed at a distance from an open end of the receiving port, the receiving port shaped to receive a female connector of another cord set; and a first splitter housing;

wherein the other end of the corresponding wires opposite the one end of the third electrical cord are electrically connected to the corresponding wires at a first location on the second electrical cord of the adapter;

wherein the first splitter housing encloses the electrical connection between the other end of the third electrical cord and the first location on the second electrical cord;

wherein the second male connector of the adapter permits a cord set or multiple cord sets to be connected together and installed in either direction; and wherein the electrical assembly receives power when either the second female connector of the adapter is connected to the first male connector of the cord set or when the second male connector of the adapter is connected to the first female connector of the cord set and the male plug is plugged into an electrical outlet.

3. An electrical cord assembly of claim 1, wherein the first electrical cord and the second electrical cord further comprising a grounding wire;

wherein the first male connector of the cord set further includes a housing enclosing a ground prong with terminal, the ground terminal electrically connected to the grounding wire of the first electrical cord, the ground prong is disposed at a distance from the open end of the receiving port of the housing of the first male connector;

wherein the housing of the first female connector of the cord set further includes a ground slot.

wherein the electrical receptacle of the first female connector of the cord set further includes a ground contact with terminal, the ground contact with terminal disposed in the ground slot, the ground terminal electrically connected to the grounding wire of the first electrical cord, the ground slot for receiving a ground prong of a mating male connector;

wherein the housing of the second female connector of the adapter further includes a ground slot.

wherein the electrical receptacle of the second female connector of the adapter includes a ground contact with terminal, the ground contact with terminal disposed in the ground slot, the ground terminal electrically connected to the grounding wire of the second electrical cord, the ground slot for receiving a ground prong of the first male connector of the cord set; and wherein the male plug of the adapter includes a housing for a ground prong with terminal, the ground terminal enclosed in the housing and electrically connected to the grounding wire of the second electrical cord, the ground prong for mating with a ground slot of the electrical outlet.

4. An electrical cord assembly of claim 2, wherein the cord set further comprises:

a third electrical cord;

a third female connector electrically connected to one end of the third electrical cord;

wherein the third female connector includes a housing enclosing an electrical receptacle, the housing including a hot slot and a neutral slot, the electrical receptacle including a hot contact with terminal and a neutral contact with terminal, the hot contact with terminal disposed in the hot slot, the neutral contact with terminal disposed in the neutral slot, the hot terminal and the neutral terminal electrically connected to the corresponding wires at the one end of the third electrical cord; and a first splitter housing;

wherein the corresponding wires on the other end opposite the one end of the third electrical cord are electrically connected to the corresponding wires at a first location near the first male connector on the first electrical cord of the cord set;

wherein the first splitter housing encloses the electrical connection between the other end of the third electrical cord and the first location on the first electrical cord of the cord set;

wherein the third female connector of the cord set permits a cord set or multiple cord sets to be connected together and installed in any direction.

5. The electrical assembly of claim 2, wherein the assembly includes a polarity connection;

wherein the contact slots of the female connectors have two different size openings for use with two different size prongs of the corresponding male connectors, wherein the two prongs of each of the male connectors include two different sizes for inserting into the contact slots of the corresponding female connectors in one way only, and wherein the neutral prong of the male plug of the adapter is wider than the hot prong for inserting into a conventional polarized electrical receptacle or outlet in one way only, for maintaining one polarity only.

6. An electrical cord assembly of claim 2, wherein the first, second, and third electrical cords. each further including a grounding wire;

wherein the housing of the first female connector of the cord set further includes a ground slot, wherein the electrical receptacle of the first female connector of the cord set further includes a ground contact with terminal, the ground contact with terminal disposed in the ground slot, the ground terminal electrically connected to the grounding wire of the first electrical cord, the ground slot for receiving a ground prong of a mating male connector;

wherein the housing of the first male connector of the cord set further includes a ground prong with terminal, the ground terminal electrically connected to the grounding wire of the first electrical cord, the ground prong disposed at a distance from the open end of the receiving port of the housing of the first male connector;

wherein the housing of the second female connector of the adapter further includes a ground slot, wherein the electrical receptacle of the second female connector of the adapter further includes a ground contact with terminal, the ground contact with terminal disposed in the ground slot, the around terminal electrically connected to the grounding wire of the second electrical cord, the ground slot for receiving a ground prong of the first male connector of a cord set;

wherein the housing of the second male connector of the adapter further includes a ground prong with terminal, the ground terminal is electrically connected to one end of the grounding wire of the third electrical cord. the ground prong disposed at a distance from an open end of the receiving port:

wherein the other end opposite the one end of the grounding wire of the third electrical cord is electrically connected to the first location on the second electrical cord of the adapter, wherein the splitter housing further encloses the electrical connection between the other end of the grounding wire of the third electrical cord and the first location on the second electrical cord:

wherein the male plug of the adapter further includes a housing for a ground prong with terminal, the ground terminal enclosed in the housing and electrically connected to the other end opposite the one end of the grounding wire of the second electrical cord, the ground prong for mating with a ground slot of the electrical outlet.

7. The electrical assembly of claim 4, further comprising one or more light emitting devices electrically connected to the electrical cords.

8. The electrical assembly of claim 7, further comprising one or more light sockets electrically connected to the electrical cords for receiving and operating the one or more light emitting devices.

9. The electrical assembly of claim 8, wherein the housing of each of the female connectors comprises a slot disposed between the hot slot and the neutral slot, the slot shaped to receive a protective partition disposed between a hot prong and a neutral prong of a male connector of another electrical cord; and wherein the receiving port of each of the male connectors comprises a protective partition, the protective partition disposed between the hot prong and the neutral prong, the protective partition shaped to insert in a slot of a female connector of another electrical cord.

10. The electrical assembly of claim 8, further comprising a clip to secure the one or more light sockets to a structure, the clip including an elongated member attached to the light socket, forming a light socket clip.

11. An electrical assembly of claim 10, wherein the light socket clip further comprises:

a light socket comprising:

an exterior housing, a plurality of first mounting members disposed on the exterior housing, the plurality of first mounting members comprising of two mounting members each having a pivot bore opening, a first spring retaining slot disposed on the exterior housing for retaining a first bent arm of a torsion spring;

a torsion spring, the torsion spring having a first end, a second end opposite the first end, a first arm extending from the first end, and a second arm extending from the second end, the first arm extending from the first end is bent inward at a first location of the extending arm, the second arm extending from the second end is bent inward at a first location of the extending arm;

wherein the elongated member of the clip further comprises:

a second spring retaining slot disposed on the elongated member for retaining the second bent arm of the torsion spring, and a plurality of second mounting members disposed on the elongated member, the plurality of second mounting members comprising of two mounting members each having a pivot bore opening, wherein the pivot bore openings of the plurality of first mounting members align with the pivot bore openings of the plurality of second mounting members for receiving a retaining pin;

wherein the torsion spring includes an opening between the two ends for aligning with the pivot bore openings of the mounting members; and a retaining pin, the retaining pin for securing the light socket clip assembly together;

wherein the light socket is one half of the clip and the elongate member is the other half of the clip, operated by gripping the elongate member and the exterior housing of the light socket.

12. The electrical assembly of claim 10, wherein the housing of each of the female connectors comprises a slot disposed between the hot slot and the neutral slot, the slot shaped to receive a protective partition disposed between a hot prong and a neutral prong of a male connector of another electrical cord.

13. The electrical assembly of claim 10, wherein the light socket clip further comprises:

a light socket comprising:

an exterior housing, a plurality of first mounting members disposed on the exterior housing, the plurality of first mounting members comprising of two mounting members each having a pivot bore opening; and a first spring retaining housing disposed on the exterior housing for retaining a first end of a compression spring;

a compression spring, the compression spring having a first end and a second end opposite the first end;

wherein the elongated member comprises:

a second spring retaining housing disposed on the elongated member for retaining the second end of the compression spring, and a plurality of second mounting members disposed on the elongated member, the plurality of second mounting members comprising of two mounting members each having a pivot bore opening;

wherein the pivot bore openings of the plurality of first mounting members align with the pivot bore openings of the plurality of second mounting members, each for receiving a retaining pin;

a retaining pin, the retaining pin for securing the light socket clip assembly together;

wherein the light socket is one half of the clip and the elongate member is the other half of the clip, operated by gripping the elongate member and the exterior housing of the light socket.

14. An electrical cord assembly of claim 13, wherein the light socket clip further comprises:

a rubber boot cover having a first open end and a second open end opposite the first open end;

wherein the light socket further comprises:

a first external outer lip disposed on an exterior open end of the first spring retaining housing for receiving the first open end of the rubber boot cover;

wherein the elongate member further comprises:

a second external outer lip disposed on an exterior open end of the second spring retaining housing for receiving the second open end of the rubber boot cover;

wherein the rubber boot cover for covering the compression spring.

15. The electrical assembly of claim 12, wherein the receiving port of each of the male connectors comprises a protective partition, the protective partition disposed between the hot prong and the neutral prong, the protective partition shaped to insert in a slot of a female connector of another electrical cord.

16. An electrical cord assembly of claim 15, further comprising:

a splitter adapter comprising:

a fourth electrical cord;

a third female connector electrically connected to one end of the fourth electrical cord;

wherein the third female connector includes a housing enclosing an electrical receptacle, the housing including a hot slot and a neutral slot, the electrical receptacle including a hot contact with terminal and a neutral contact with terminal, the hot contact with terminal disposed in the hot slot, the neutral contact with terminal disposed in the neutral slot, the hot terminal and the neutral terminal electrically connected to the corresponding wires at one end of the fourth electrical cord;

a third male connector electrically connected to the other end opposite the one end of the fourth electrical cord;

wherein the third male connector includes a housing enclosing a hot prong with terminal and a neutral prong with terminal, the hot terminal and the neutral terminal electrically connected to the other end of the corresponding wires of the fourth electrical cord, the housing of the third male connector further including a receiving port in which the hot prong and neutral prong are disposed at a distance from an open end of the receiving port, the receiving port shaped to receive a female connector of another electrical cord or cord set;

a fifth electrical cord;

a fourth female connector connected to one end of the fifth electrical cord;

wherein the fourth female connector includes a housing enclosing an electrical receptacle, the housing including a hot slot and a neutral slot, the electrical receptacle including a hot contact with terminal and a neutral contact with terminal, the hot contact with terminal disposed in the hot slot, the neutral contact with terminal disposed in the neutral slot, the hot terminal and the neutral terminal electrically connected to the corresponding wires of the one end of the fifth electrical cord; and a second splitter housing;

wherein the other end of the corresponding wires opposite the one end of the fifth electrical cord are electrically connected to the corresponding wires at a first location on the fourth electrical cord of the splitter adapter;

wherein the second splitter housing encloses the electrical connection between the other end of the fourth electrical cord and the first location on the fourth electrical cord, forming a splitter adapter;

wherein the splitter adapter permits additional cord sets to be connected together and installed in any direction.

17. The electrical assembly of claim 15, wherein the assembly includes a polarity connection;

wherein the contact slots of each of the female connectors have two different size openings for use with two different size prongs of the corresponding male connectors, wherein the two prongs of each of the male connectors include two different sizes for inserting into the contact slots of the corresponding female connectors in one way only, and wherein the neutral prong of the male plug of the adapter is wider than the hot prong for inserting into a conventional polarized electrical receptacle or outlet in one way only, for maintaining one polarity only.

18. The electrical assembly of claim 15, further comprising additional cord sets, and wherein the light emitting devices comprise of light emitting diodes.

19. The electrical assembly of claim 15, further comprising:

a grip, the grip provided on each of the housings of the female connectors, and the male connectors for easily separating the connectors apart when connected together.

20. The electrical assembly of claim 1, wherein the male plug comprises:

an activating female connector;

a removable activating male fitting;

the activating female connector electrically connected to the second electrical cord and shaped to receive the removable activating male fitting, the activating female connector includes a housing enclosing an electrical receptacle, the electrical receptacle including a hot contact with terminal disposed within a continuous hot contact slot that extends there through and a neutral contact with terminal disposed within a continuous neutral contact slot that extends there through, the hot and neutral contacts each including one or more sides, top and bottom edge surfaces, and a terminal extending from one side for electrically connecting to the corresponding wires of the second electrical cord, the hot and neutral contacts having an open continuous passageway from the top edge surface to the bottom edge surface, forming the continuous hot and neutral contact slots, for receiving a hot prong and a neutral prong of the removable activating male fitting;

the removable activating male fitting includes a top, two sides, two ends, a hot prong, a neutral prong, and at least one slot disposed in one of the end surfaces, the hot prong and the neutral prong embedded and attached to the top and pointing to the opposite open end, wherein the least one slot disposed in the end surface for mounting over the second electrical cord connected to the activating female connector when connecting the removable activating male fitting to the activating female connector to form the male plug.

21. The electrical assembly of claim 20, wherein the activating male fitting further includes a mounting strap;

the mounting strap having two ends, one end of the mounting strap attached to the activating male fitting, the opposing end of the mounting strap includes a mount with hole for physically securing near or to the electrical outlet, the electrical outlet including either a receptacle, an electrical box, or an electrical cover.

22. A light socket clip comprising:

a light socket electrically connecting to an electrical cord, cable, or the like, receiving and operating one or more light emitting devices, the light socket comprising:

an exterior housing, a plurality of first mounting members disposed on the exterior housing, the plurality of first mounting members comprising of two mounting members each having a pivot bore opening; and a first spring retaining housing disposed on the exterior housing for retaining the first end of a compression spring;

a compression spring, the compression spring having a first end and a second end opposite the first end:

a clip including an elongated member attached to the light socket;

wherein the elongated member comprises:

a plurality of second mounting members disposed on the elongated member, the plurality of second mounting members comprising of two mounting members each having a pivot bore opening; and a second spring retaining housing disposed on the elongated member for retaining the second end of the compression spring;

wherein the pivot bore openings of the plurality of first mounting members align with the pivot bore openings of the plurality of second mounting members for receiving a retaining pin; and a retaining pin, the retaining pin for securing the light socket clip assembly together;

wherein the light socket is one half of the clip and the elongate member is the other half of the clip, operated by gripping the elongate member and the exterior housing of the light socket.

23. A light socket clip of claim 22, further comprising:

a rubber boot cover having a first open end and a second open end opposite the first open end;

wherein the light socket further comprises:

a first external outer lip disposed on an exterior open end of the first spring retaining housing for receiving the first open end of the rubber boot cover;

wherein the elongate member further comprises:

a second external outer lip disposed on an exterior open end of the second spring retaining housing for receiving the second open end of the rubber boot cover;

wherein the rubber boot cover for covering the compression spring.

* * * * *